US009259048B2

(12) United States Patent
Aveni

(10) Patent No.: US 9,259,048 B2
(45) **Date of Patent: *Feb. 16, 2016**

(54) ARTICLE OF FOOTWEAR WITH STRAPS

(71) Applicant: Nike, Inc., Beaverton, OR (US)

(72) Inventor: Michael A. Aveni, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 312 days.

This patent is subject to a terminal disclaimer.

(21) Appl. No.: 13/868,722

(22) Filed: Apr. 23, 2013

(65) Prior Publication Data

US 2013/0305563 A1 Nov. 21, 2013

Related U.S. Application Data

(63) Continuation of application No. 12/608,824, filed on Oct. 29, 2009, now Pat. No. 8,448,351.

(51) Int. Cl.

| | |
|---|---|
| ***A43B 3/24*** | (2006.01) |
| ***A43B 3/12*** | (2006.01) |
| ***A43B 3/10*** | (2006.01) |
| ***A43B 3/26*** | (2006.01) |

(52) U.S. Cl.

CPC ..... *A43B 3/126* (2013.01); *A43B 3/103* (2013.01); *A43B 3/248* (2013.01); *A43B 3/26* (2013.01)

(58) Field of Classification Search

CPC ..... A43B 3/103; A43B 3/12; A43B 3/122; A43B 3/124; A43B 3/126; A43B 3/26

USPC ..... 36/11.5, 50.1

See application file for complete search history.

(56) References Cited

U.S. PATENT DOCUMENTS

| | | | | |
|---|---|---|---|---|
| 1,402,375 | A * | 1/1922 | Parisi | 602/30 |
| 2,297,595 | A * | 9/1942 | Weinstat | 36/11.5 |
| 2,932,097 | A | 4/1960 | George | |
| 3,066,678 | A * | 12/1962 | Riecken | 36/166 |
| 3,121,962 | A | 2/1964 | Gullo | |
| 3,275,002 | A * | 9/1966 | Scholl | 36/140 |
| 3,928,927 | A | 12/1975 | Brown et al. | |
| 4,051,610 | A | 10/1977 | Shigeji | |
| 4,813,162 | A * | 3/1989 | Harris | 36/88 |
| 4,896,439 | A | 1/1990 | Morgan | |

(Continued)

FOREIGN PATENT DOCUMENTS

| | | |
|---|---|---|
| AR | 078803 | 12/2011 |
| CN | 102595948 | 7/2012 |

(Continued)

OTHER PUBLICATIONS

Response filed Sep. 26, 2014 in European Patent Application No. 13178115.5.

(Continued)

*Primary Examiner* — Jila M Mohandesi

(74) *Attorney, Agent, or Firm* — Plumsea Law Group, LLC

(57) ABSTRACT

An article of footwear with straps is disclosed. The article includes provisions for releasably securing the straps to a sole structure of the article. End portions of the straps are provided with separable portions that can be individually inserted through apertures in the sole structure. In addition, a thong portion includes separable portions that can be individually inserted through an aperture in the sole structure.

20 Claims, 18 Drawing Sheets

(56) References Cited

U.S. PATENT DOCUMENTS

| | | | | |
|---|---|---|---|---|
| 5,802,738 | A | 9/1998 | Ferniani | |
| D513,447 | S | 1/2006 | Corneau | |
| 7,367,142 | B2 | 5/2008 | Ferniani et al. | |
| RE42,483 | E | 6/2011 | Comeau | |
| 8,448,351 | B2 | 5/2013 | Aveni | |
| 2008/0052958 | A1 | 3/2008 | Pan | |
| 2008/0110054 | A1 | 5/2008 | Lewis | |
| 2008/0168682 | A1 | 7/2008 | Le | |
| 2008/0196269 | A1 | 8/2008 | Bathum | |
| 2009/0038181 | A1 | 2/2009 | Loughnane | |
| 2009/0044423 | A1 | 2/2009 | Amsterdam | |
| 2009/0113759 | A1* | 5/2009 | Heid | 36/92 |
| 2009/0133289 | A1 | 5/2009 | Cantoni | |
| 2009/0193684 | A1 | 8/2009 | Diamond | |
| 2009/0320325 | A1 | 12/2009 | Escario | |
| 2011/0099840 | A1 | 5/2011 | Aveni | |

FOREIGN PATENT DOCUMENTS

| | | | |
|---|---|---|---|
| EP | 0 176 041 | A1 | 4/1986 |
| EP | 0176041 | | 4/1986 |
| EP | 2493345 | | 9/2012 |
| EP | 2493345 | A1 | 9/2012 |
| EP | 2 705 767 | A1 | 3/2014 |
| EP | 2 705 767 | B1 | 3/2015 |
| FR | 1 012 306 | A | 7/1952 |
| FR | 2803492 | | 7/2001 |
| GB | 868144 | A | 5/1961 |
| JP | 52015753 | | 2/1977 |
| JP | 2002045202 | | 2/2002 |
| JP | 2008167988 | | 7/2008 |
| JP | 2013509246 | | 3/2013 |
| WO | 2010058262 | | 5/2010 |
| WO | 2011059656 | | 5/2011 |

OTHER PUBLICATIONS

Response filed Jul. 14, 2014 in Chinese Patent Application No. 201080049120.0.

Decision to Grant a Patent dated Jul. 8, 2014 in Japanese Patent Application No. 2012-536892.

Office Action dated Jul. 29, 2014 in European Patent Application No. 13178115.5.

Notice of Allowance dated Nov. 13, 2014 in European Patent Application No. 13178115.5.

Response to Office Action filed May 1, 2014 in Japanese Patent Application No. 2012-536892.

Office Action dated Oct. 20, 2014 in Chinese Patent Application No. 201080049120.0.

International Search Report and Written Opinion mailed Mar. 18, 2011 in International Application No. PCT/US2010/053618.

International Preliminary Report on Patentability (including Written Opinion of the ISA) mailed May 10, 2012 in International Application No. PCT/US2010/053618.

Voluntary Amendments filed Nov. 22, 2012 in Chinese Patent Application No. 201080049120.0 with English-language translation thereof.

Notice of Intention to Grant mailed May 8, 2013 in European Application No. 10788165.8.

Voluntary Amendments filed Oct. 21, 2013 in Brazilian Patent Application No. 1120120069691.

Partial European Search Report dated Feb. 3, 2014 in European Patent Application No. 13178115.

Response to Office Action dated Jan. 8, 2014 in European Patent Application No. 13178115.

Japanese Office Action dated Feb. 4, 2014 in Japanese Patent Application No. 2012-536892.

Korean Notice of Allowance dated Dec. 11, 2013 in Korean Patent Application No. 10-2012-7010142.

Chinese Office Action issued Feb. 27, 2014 in Chinese Patent Application No. 201080049120.

Response filed Jan. 4, 2015 in Chinese Patent Application No. 201080049120.0.

Response filed Jun. 23, 2014 in European Patent Application No. 13178115.5.

Notice of Allowance dated Sep. 8, 2015 in Chinese Patent Application No. 201080049120.0.

Office Action mailed Oct. 26, 2015 in MX Application No. MX/a/2012/005010, 5 pages.

Office Action dated Sep. 21, 2015 in AR Application No. P100103960.

Response to Office Action filed on Dec. 17, 2015 in Argentina Application No. P 10 01 03960, 4 pages.

Voluntary claim amendments filed Nov. 19, 2015 in Argentine Application No. P150103769.

Voluntary claim amendments filed Nov. 19, 2015 in Argentine Application No. P150103768.

* cited by examiner

ARTICLE OF FOOTWEAR WITH STRAPS

CROSS-REFERENCE TO RELATED APPLICATION

This application is a continuation of prior pending nonprovisional application Ser. No. 12/608,824, filed 29 Oct. 2009, published as U.S. Patent Appl. Publ. No. 2011/0099840 on 5 May 2011, the entire disclosure of which is incorporated herein by reference.

BACKGROUND

The present invention relates generally to an article of footwear, and in particular to an article of footwear with straps.

Methods of securing straps to a sole have been previously proposed. Bathum (U.S. patent application publication number 2008/0196269) teaches sandals with adjustable center post assemblies. Bathum teaches a center post assembly including a body portion fixedly attached to a sole assembly and two flexible second straps projecting from the post. The straps may be inserted through an aperture in the post to secure the straps.

Loughnane (U.S. patent application publication number 2009/0038181) teaches footwear with detachable straps. Loughnane teaches a sole member having a pair of loops attached on an opposite side of the sole. A strap is attached to the sole by tying loops to the respective grommets.

Bathum or Loughnane require the use of various fasteners for securing straps in place on footwear.

SUMMARY

In one aspect, the invention provides an article of footwear, comprising: a sole structure including an aperture that extends from a top portion to a lower portion of the sole structure; a strap comprising a plurality of separable portions; each of the plurality of separable portions comprising a widened portion, the widened portions of the plurality of separable portions having a combined width; the aperture having a normal width; each widened portion having a width that is less than the normal width; and wherein the combined width is greater than the normal width.

In another aspect, the invention provides an article of footwear, comprising: a sole structure including an aperture that extends from a top portion to a lower portion of the sole structure; a thong portion comprising a first separable portion, a second separable portion and a third separable portion; the first separable portion having a first widened portion, the second separable portion having a second widened portion and the third separable portion having a third widened portion; a top portion of the aperture having a stretched cross-sectional area corresponding to the cross-sectional area of the aperture in a fully stretched position and a normal cross-sectional area corresponding to the cross-sectional area of the aperture in a non-stretched position; the first widened portion having a cross-sectional area that is less than the normal cross-sectional area, the second widened portion having a cross-sectional area that is less than the normal cross-sectional area and the third widened portion having a cross-sectional area that is less than the normal cross-sectional area; and wherein a combined cross-sectional area of the first widened portion, the second widened portion and the third widened portion is greater than the stretched cross-sectional area of the aperture.

In another aspect, the invention provides a method of assembling an article of footwear, comprising the steps of: separating a first separable portion, a second separable portion and a third separable portion of a strap; inserting a first widened portion of the first separable portion into an aperture in a sole structure, the aperture being substantially wider than the first widened portion; inserting a second widened portion of the second separable portion into the aperture, the aperture being substantially wider than the second widened portion; inserting a third widened portion of the third separable portion into the aperture, the aperture being substantially wider than the third widened portion; wherein a combined width of the first widened portion, the second widened portion and the third widened portion is substantially larger than a stretched width of the aperture; and securing the strap to the sole structure of the article of footwear.

An article of footwear, comprising: a sole structure including a first aperture and a second aperture disposed adjacent to the first aperture; a fastening portion associated with a strap for the sole structure, the fastening portion comprising a plurality of separable portions; the fastening portion having a combined position and a separated position; each separable portion of the plurality of separable portions having a separated size in the separated position that is less than a size of the first aperture and the second aperture; the separable portions having a combined size in the combined position that is greater than the second size; and where the fastening portion can be removably inserted from the first aperture and the second aperture to adjust the strap around a foot.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
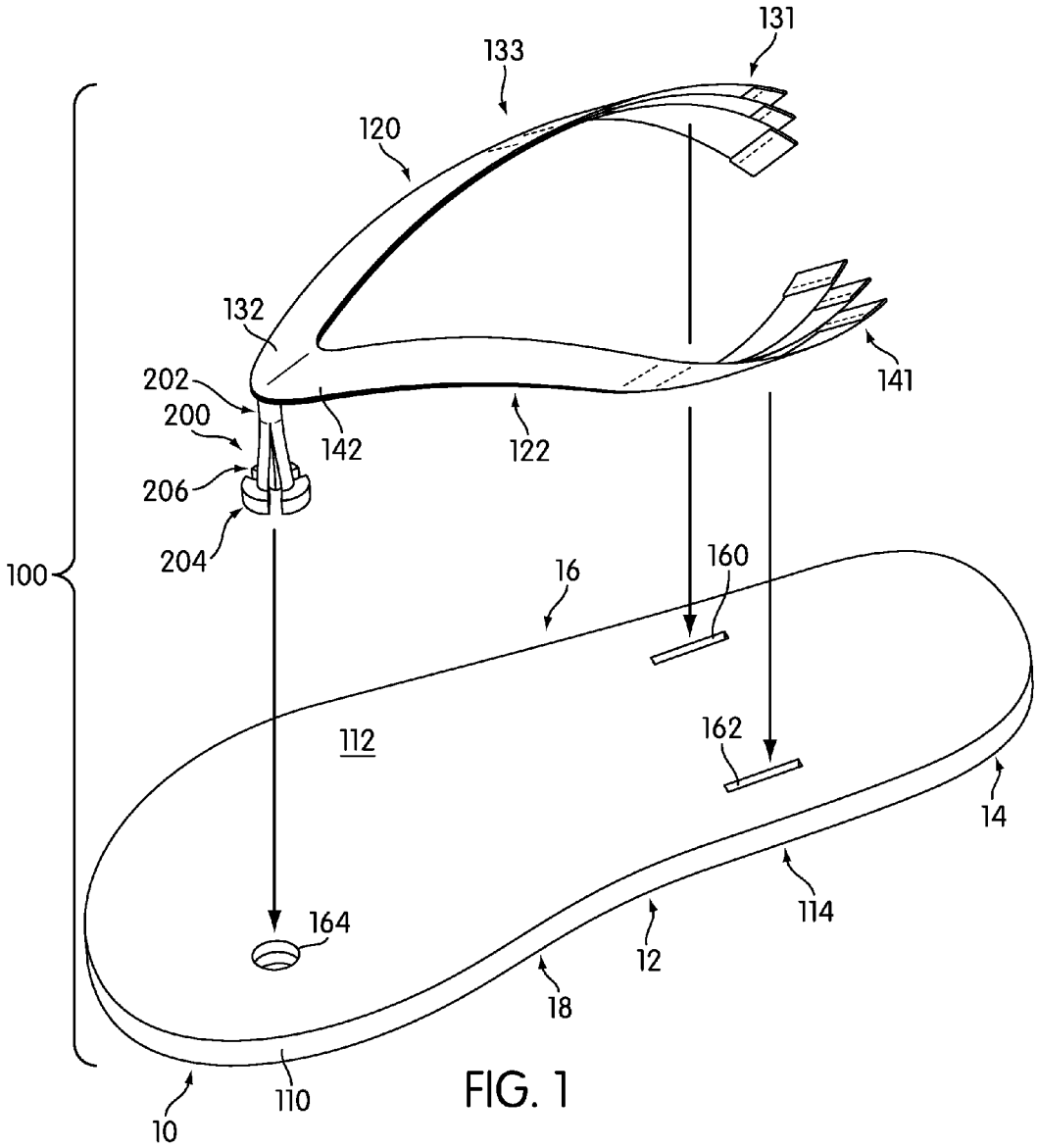
FIG. 1 is an exploded isometric view of an embodiment of an article of footwear.

FIG. 1 illustrates an isometric exploded view of an exemplary embodiment of article of footwear 100. For clarity, the following detailed description discusses an exemplary embodiment, in the form of a sandal or flip-flop, but it should be noted that the present invention could take the form of any article of footwear including, but not limited to: hiking boots, soccer shoes, football shoes, sneakers, rugby shoes, basketball shoes, baseball shoes as well as other kinds of shoes. In other embodiments, the present invention could take the form of any of the following articles of footwear including, but not limited to: clogs, mules, espadrilles, getas, jipsins, pattens, roman sandals, saltwater sandals, foam sandals, t-bar sandals as well as any other kind of open shoe or open toed shoe that utilizes straps to secure a sole to a foot. As shown in FIG. 1, article of footwear 100, also referred to simply as article 100, is intended to be used with a right foot; however, it should be understood that the following discussion may equally apply to a mirror image of article of footwear 100 that is intended for use with a left foot.

Referring to FIG. 1, for purposes of reference, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, article 100 may include lateral side 16 and medial side 18. In particular, lateral side 16 and medial side 18 may be opposing sides of article 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of article 100. Likewise, lateral side 16 and medial side 18 are intended to represent generally two sides of an article, rather than precisely demarcating article 100 into two halves. In addition, forefoot portion 10, midfoot portion 12 and heel portion 14, as well as lateral side 16 and medial side 18, can also be applied to individual components of an article, such as a sole structure and/or an upper.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of the article. Also, the term "lateral" as used throughout this detailed description and in the claims refers to a direction extending a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. It will be understood that each of these directional adjectives may be applied to individual components of an article, such as an upper and/or a sole structure.

Article 100 can include sole structure 110. In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to: natural turf, synthetic turf, dirt, as well as other surfaces.

Sole structure 110 extends between the foot and the ground when article 100 is worn. In different embodiments, sole structure 110 may include different components. For example, sole structure 110 may include an outsole, a midsole, and/or an insole. In some cases, one or more of these components may be optional. Although the exemplary embodiment does not include an upper, in other embodiments article 100 could include an upper.

Sole structure 110 can include top portion 112 that is configured to receive a foot. In some cases, top portion 112 can include provisions for increasing grip with a foot. Examples of provisions for increasing grip with a foot can include, but are not limited to: nubs, grooves, as well as any other provisions. Still further, in some cases, top portion 112 can comprise a material with a high coefficient of friction. In one embodiment, top portion 112 can comprise a substantially smooth surface. Additionally, sole structure 110 can include lower portion 114 that is disposed opposite of top portion 112.

In some embodiments, article 100 can include provisions for securing a foot to sole structure 110. In some cases, article 100 can include one or more straps that may wrap around a portion of a foot. In one embodiment, article 100 can include first strap 120 and second strap 122. First strap 120 may include first end portion 131 that is attached to lateral side 16 of sole structure 110. Second strap 122 may include first end portion 141 that is attached to medial side 18 of sole structure 110. In addition, first strap 120 may include second end portion 132 that is associated with forefoot portion 10 of article 100. Likewise, second strap 122 may include second end portion 142 that is associated with forefoot portion 10 of article 100.

In some embodiments, first strap 120 and second strap 122 may comprise two distinct straps. In other embodiments, however, first strap 120 and second strap 122 may comprise different portions of a single strap. For example, in one embodiment, second end portion 132 of first strap 120 may be integrally formed with second end portion 142 of second strap 122. In other embodiments, first strap 120 and second strap 122 could be individual straps that are sewn or otherwise joined together. In addition, while two straps are illustrated in the current embodiment, other embodiments could include additional straps or provisions for securing sole structure 110 to a foot. In another embodiment, for example, article 100 could include a heel strap that extends across a heel of a foot. In still other embodiments, additional straps could be provided in forefoot portion 10 and/or midfoot portion 12 for securing a foot to sole structure 110.

Article 100 can include provisions for attaching first strap 120 and second strap 122 to forefoot portion 10 of sole structure 110. In some embodiments, article 100 can include a thong portion that is configured to extend between forefoot portion 10 of sole structure 110 and portions of first strap 120 and second strap 122. In other embodiments, first strap 120 and second strap 122 may be directly attached to forefoot portion 10.

In the exemplary embodiment, article 100 may include thong portion 200. Thong portion 200 can include first end portion 202 and second end portion 204. In addition, thong portion 200 can include intermediate portion 206 that is disposed between first end portion 202 and second end portion 204. In some cases, first end portion 202 may be configured to attach to second end portion 132 of first strap 120 as well as second end portion 142 of second strap 122. Second end portion 204 of thong portion 200 may be attached to sole structure 110. With this arrangement, thong portion 200 can help to connect first strap 120 and second strap 122 with sole structure 110.

In some embodiments, thong portion 200 can be configured to insert between two adjacent toes of a foot. For example, in one embodiment, thong portion 200 may be attached to a portion of sole structure 110 so that thong portion 200 is inserted between the hallux (big toe) and the index toe of the foot. In another embodiment, thong portion 200 could be inserted between other adjacent toes of a foot. In other cases, thong portion 200 could be inserted between the index toe and the middle toe. In still other cases, thong portion 200 could be inserted between the middle toe and the fourth toe. In still other cases, thong portion 200 could be inserted between the fourth toe and the little toe. With this arrangement, thong portion 200 can facilitate securing sole structure 110 to a foot.

Sole structure 110 can include provisions for receiving straps. In one embodiment, sole structure 110 can include first aperture 160 and second aperture 162 disposed on lateral side 16 and medial side 18 of sole structure 110, respectively. In some cases, first aperture 160 and second aperture 162 can extend from top portion 112 to lower portion 114 of sole structure 110.

In different embodiments, the shapes of first aperture 160 and second aperture 162 can vary. Examples of different cross-sectional shapes for first aperture 160 and second aperture 162 include, but are not limited to: rounded shapes, rectangular shapes, polygonal shapes, regular shapes, irregular shapes as well as any other shapes. In an exemplary embodiment, first aperture 160 and second aperture 162 can be provided with substantially rectangular shapes.

Sole structure 110 can include provisions for receiving a thong portion. In one embodiment, sole structure 110 can include third aperture 164 disposed on forefoot portion 10 of sole structure 110. In some cases, third aperture 164 can extend from top portion 112 to lower portion 114 of sole structure 110.

In different embodiments, the shape of third aperture 164 can vary. Examples of different cross sectional shapes for third aperture 164 include, but are not limited to: rounded shapes, rectangular shapes, polygonal shapes, regular shapes, irregular shapes as well as any other shapes. In an exemplary embodiment, third aperture 164 can be provided with a substantially rounded shape.

Figure 2:
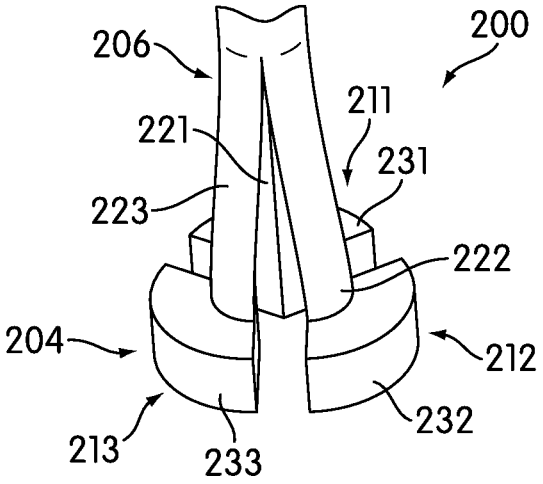
FIG. 2 is an enlarged isometric view of an embodiment of a thong portion for an article of footwear.
Figure 3:
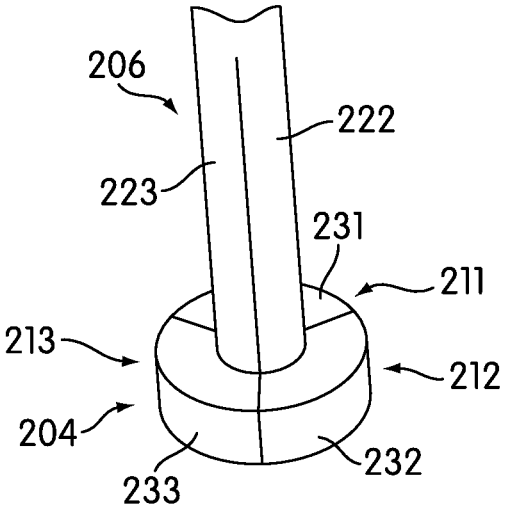
FIG. 3 is an enlarged isometric view of an embodiment of a thong portion for an article of footwear.

FIGS. 2 and 3 illustrate enlarged isometric views of an embodiment of thong portion 200. In particular, FIG. 2 illustrates an enlarged isometric view of thong portion 200 in a separated position, while FIG. 3 illustrates an enlarged isometric view of thong portion 200 in a combined position. Referring to FIGS. 2 and 3, in some embodiments, thong portion 200 can comprise a plurality of separable portions. In some cases, thong portion 200 can comprise two or more separable portions. In one embodiment, thong portion 200 can comprise three separable portions.

In this embodiment, thong portion 200 may comprise first separable portion 211, second separable portion 212 and third separable portion 213. First separable portion 211 may further comprise first narrow portion 221 and first widened portion 231. Similarly, second separable portion 212 may further comprise second narrow portion 222 and second widened portion 232. Also, third separable portion 213 may further comprise third narrow portion 223 and third widened portion 233. In some cases, first widened portion 231, second widened portion 232 and third widened portion 233 can be provided with substantially larger cross-sectional areas than first narrow portion 221, second narrow portion 222 and third narrow portion 223, respectively. It will be understood that the term widened portion, as used throughout this detailed description and in the claims is not restricted to a particular direction or dimension associated with a thong portion. In the current embodiment, for example, a widened portion may be associated with a larger cross-sectional area than a narrow portion, where the cross-sectional areas are perpendicular to a longitudinal axis of a separable portion. In other embodiments, however, a widened portion could be larger in any other dimension or direction than a narrow portion.

Thong portion 200 may be disposed in a separated position or a combined position. In a separated position, first separable portion 211, second separable portion 212 and third separable portion 213 may be separated or spaced apart from one another. In particular, in the separated position, first separable portion 211, second separable portion 212 and third separable portion 213 may be configured to move substantially independently of one another. In contrast, in the combined position, first separable portion 211, second separable portion 212 and third separable portion 213 may be disposed adjacent to one another. In other words, there may be substantially no gaps between first separable portion 211, second separable portion 212 and third separable portion 213 in the combined position. In some cases, first separable portion 211, second separable portion 212 and third separable portion 213 may move as a composite portion in the combined position.

In some embodiments, first narrow portion 221, second narrow portion 222 and third narrow portion 223 can comprise stem-like portions that extend from intermediate portion 206 of thong portion 200 towards second end portion 204. In some cases, when thong portion 200 is disposed in a combined position, first narrow portion 221, second narrow portion 222 and third narrow portion 223 can be fit together to form a substantially cylindrical shape. In other cases, first narrow portion 221, second narrow portion 222 and third narrow portion 223 could be fit together to form any other type of shape. Additionally, first widened portion 231, second widened portion 232 and third widened portion 233 may comprise wedge-like portions extending from first narrow portion 221, second narrow portion 222 and third narrow portion 223, respectively. In some cases, when thong portion 200 is disposed in a combined position, first narrow portion 221, second narrow portion 222 and third narrow portion 223 can be fit together to form a substantially disc-like or button-like shape.

In different embodiments, one or more separable portions could be integrally formed. For example, in one embodiment, first separable portion 211, second separable portion 212 and third separable portion 213 may be formed by dividing second end portion 204 of thong portion 200 into approximately three even portions. In other words, first separable portion 211, second separable portion 212 and third separable portion 213 could form a substantially monolithic portion of thong portion 200. In some cases, first separable portion 211, second separable portion 212 and third separable portion 213 may be divided along a central axis of thong portion 200. In other embodiments, however, first separable portion 211, second separable portion 212 and third separable portion 213 may be distinct portions that are joined together. For example, in another embodiment, first separable portion 211, second separable portion 212 and third separable portion 213 may be joined together using an adhesive or any kind of fastener.

In the current embodiment, first separable portion 211, second separable portion 212 and third separable portion 213 may have substantially similar shapes. In other embodiments, however, first separable portion 211, second separable portion 212 and third separable portion 213 could be associated with substantially different shapes. Additionally, while the current embodiment includes three separable portions, other embodiments could include any other number of separable portions.

In some embodiments, a thong portion could include provisions for maintaining separable portions in a combined position. For example, in some cases, separable portions could include provisions for snapping together into the combined position. In other cases, separable portions could be braided or interlocked together in some manner. In still other cases, a thong portion may be provided with a ring that may slide over narrow portions of the separable portions to lock them in the combined position. In still other cases, separable portions could be twisted together in the combined position. It will be understood that any other provisions for maintaining separable portions in a combined position could be used.

Figure 4:
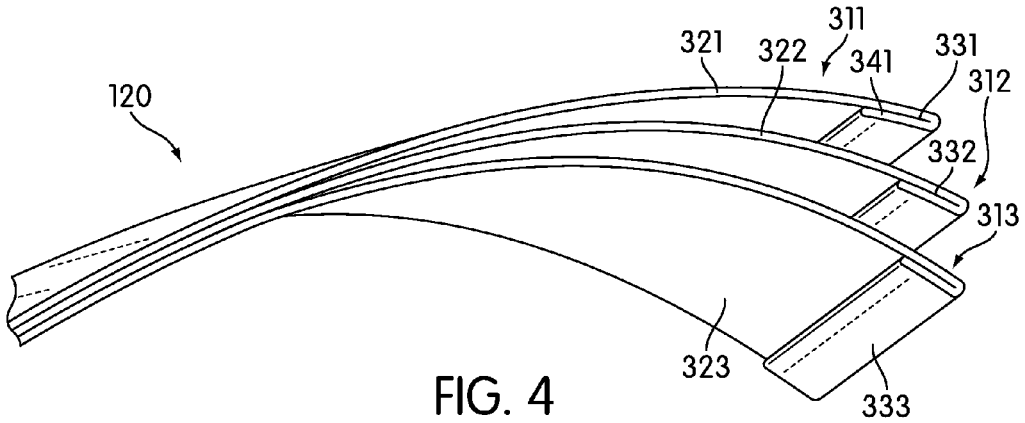
FIG. 4 is an enlarged isometric view of an embodiment of a strap for an article of footwear.
Figure 5:
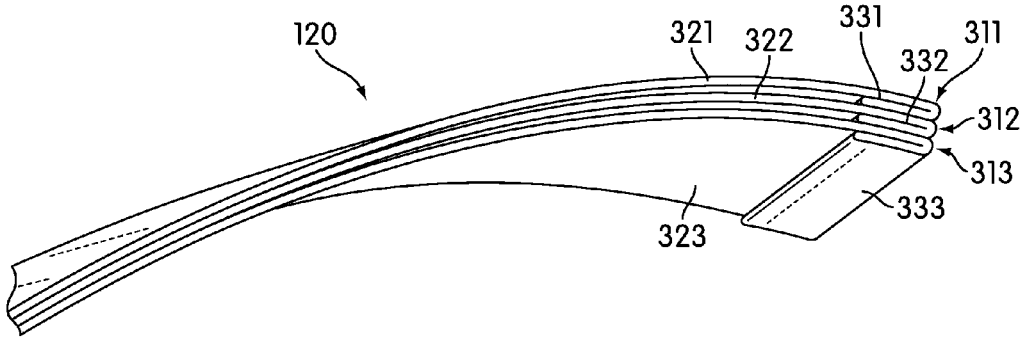
FIG. 5 is an enlarged isometric view of an embodiment of a strap for an article of footwear.

FIGS. 4 and 5 illustrate enlarged isometric views of an embodiment of first strap 120. In particular, FIG. 4 illustrates an enlarged isometric view of first strap 120 in a separated position, while FIG. 5 illustrates an enlarged isometric view of first strap 120 in a combined position. Although the current embodiment only illustrates an enlarged view of first strap 120, it will be understood that in some embodiments second strap 122 may be substantially identical to first strap 120.

Referring to FIGS. 4 and 5, first strap 120 may comprise a plurality of separable portions. In some cases, first strap 120 may comprise two or more separable portions. In one embodiment, first strap 120 may comprise three separable portions. In this embodiment, first strap 120 may comprise first separable portion 311, second separable portion 312 and third separable portion 313. First separable portion 311 may further comprise first narrow portion 321 and first widened portion 331. Similarly, second separable portion 312 may further comprise second narrow portion 322 and second widened portion 332. Also, third separable portion 313 may further comprise third narrow portion 323 and third widened portion 333. In some embodiments, first widened portion 331, second widened portion 332 and third widened portion may be substantially wider than first narrow portion 321, second narrow portion 322 and third narrow portion 323, respectively, in at least one direction. It will be understood that the term widened portion, as used throughout this detailed description and in the claims is not restricted to a particular direction or dimension associated with a strap. In the current embodiment, for example, a widened portion may have a greater extension along a dimension perpendicular to a surface of a separable portion than a narrow portion. In other embodiments, however, a widened portion could be larger in any other dimension or direction than a narrow portion.

In some embodiments, first strap 120 may be configured in a separated position or a combined position. In a separated position, first separable portion 311, second separable portion 312 and third separable portion 313 may be separated or spaced apart from one another. In particular, in the separated position, first separable portion 311, second separable portion 312 and third separable portion 313 may be configured to move substantially independently of one another. In contrast, in the combined position, first separable portion 311, second separable portion 312 and third separable portion 313 may be disposed adjacent to one another. In other words, in the combined position, first separable portion 311, second separable portion 312 and third separable portion 313 may be stacked closely together within minimal spacing between them. In some cases, in the combined position, first separable portion 311, second separable portion 312 and third separable portion 313 may move as a composite portion.

In some embodiments, first separable portion 311, second separable portion 312 and third separable portion 313 may comprise ribbon-like portions or strips that extend from intermediate portion 133 of first strap 120 towards first end portion 131. In some cases, first separable portion 311 may be continuously formed with intermediate portion 133 of first strap 120. In addition, second separable portion 312 and third separable portion 313 may be attached to intermediate portion 133 by sewing or stitching. In other embodiments, however, first separable portion 311, second separable portion 312 and third separable portion 313 could be joined together in any other manner. In another embodiment, for example, first separable portion 311, second separable portion 312 and third separable portion 313 could all be integrally formed with first strap 120.

In some embodiments, first widened portion 331, second widened portion 332 and third widened portion 333 may comprise folded portions of first separable portion 311, second separable portion 312 and third separable portion 313, respectively. In this embodiment, for example, end portion 341 of first separable portion 311 may be folded over to form first widened portion 331. In some cases, end portion 341 may be stitched in place. In a similar manner, end portions of second separable portion 312 and third separable portion 313 may be folded over to form second widened portion 332 and third widened portion 333. With this arrangement, first widened portion 331, second widened portion 332 and third widened portion 333 may be approximately twice as wide as first narrow portion 321, second narrow portion 322 and third narrow portion 323, respectively.

In the current embodiment, first separable portion 311, second separable portion 312 and third separable portion 313 may have substantially similar shapes. In other embodiments, however, first separable portion 311, second separable portion 312 and third separable portion 313 could be associated with substantially different shapes. Additionally, while the current embodiment includes three separable portions, other embodiments could include any other number of separable portions.

In some embodiments, a thong portion could include provisions for maintaining separable portions in a combined position. For example, in some cases, separable portions associated with a strap could be attached to one another using a hook and loop type fastener such as Velcro®. In another embodiment, a buckle could be used to maintain the separable portions in the combined position. It will be understood that any other provisions for maintaining separable portions in a combined position could be used.

An article of footwear can include provisions for releasably securing a strap with separable portions to an aperture of a sole structure. In some embodiments, widened portions of the separable portions could be provided with widths that may fit into the aperture. In addition, the combined widths of the widened portions could be larger than the aperture width to prevent the separable portions from pulling out of the aperture.

FIGS. 6 through 13 illustrate embodiments of a method of fastening first strap 120 with sole structure 110. Although the current embodiment only illustrates a method for fastening first strap 120, it will be understood that a similar technique may be used for fastening second strap 122 to sole structure 110. Referring to FIGS. 6 through 13, first strap 120 may be disposed in the separated position such that first separable portion 311, second separable portion 312 and third separable portion 313 are separated and may move substantially independently of one another.

For purposes of understanding the current embodiments, the term width is used. In conjunction with an aperture, the term width may refer to a dimension of the aperture that is generally directed along a lateral direction of a sole structure. In other embodiments, however, the term width could be used to refer to another dimension of an aperture. In conjunction with a separable portion of a strap, the term width may refer to a dimension that is generally perpendicular to both the longitudinal and lateral directions of a strap. In other embodiments, however, the term width could refer to another dimension of a strap.

In some embodiments, first aperture 160 can include top portion 180 and lower portion 182. Top portion 180 may be open on top portion 112 of sole structure 110. Lower portion 182 may be open on lower portion 114 of sole structure 110. In this case, top portion 180 may be provided with width W1, while lower portion 182 may be provided with width W2 that is substantially larger than width W1. In one embodiment, width W1 may correspond to the width of top portion 180 in a non-stretched position. In the current embodiment, width W1 and width W2 of top portion 180 and lower portion 182, respectively, are taken with respect to a lateral direction of sole structure 110. In other cases, however, width W1 and width W2 could be taken with respect to any other direction relative to sole structure 110.

In some cases, first widened portion 331, second widened portion 332 and third widened portion 333 may be provided with substantially similar widths. In other cases, however, first widened portion 331, second widened portion 332 and third widened portion 333 could have substantially different widths. In an exemplary embodiment, for purposes of clarity, first widened portion 331, second widened portion 332 and third widened portion 333 may all have width W3. In the current embodiment, width W3 may be associated with a dimension of first widened portion 331, second widened portion 332 and third widened portion 333 that is substantially perpendicular to the lateral and longitudinal directions of first strap 120.

Additionally, in some cases, first narrow portion 321, second narrow portion 322 and third narrow portion 323 may be provided with substantially similar widths. In other cases, however, first narrow portion 321, second narrow portion 322 and third narrow portion 323 may be provided with substantially different widths. In an exemplary embodiment, for purposes of clarity, first narrow portion 321, second narrow portion 322 and third narrow portion 323 may all have width W4, which is substantially smaller than width W3. In the current embodiment, width W4 may be associated with a dimension of first narrow portion 321, second narrow portion 322 and third narrow portion 323 that is substantially perpendicular to the lateral and longitudinal directions of first strap 120.

Figure 6:
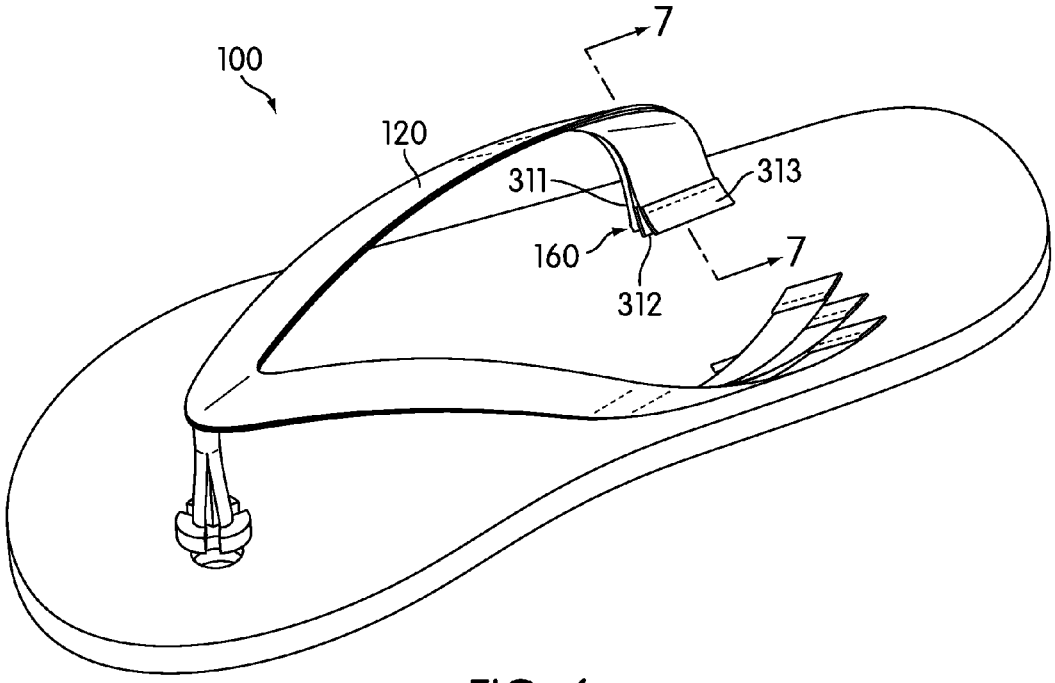
FIG. 6 is an isometric view of an embodiment of a strap being inserted through an aperture in a sole structure.
Figure 7:
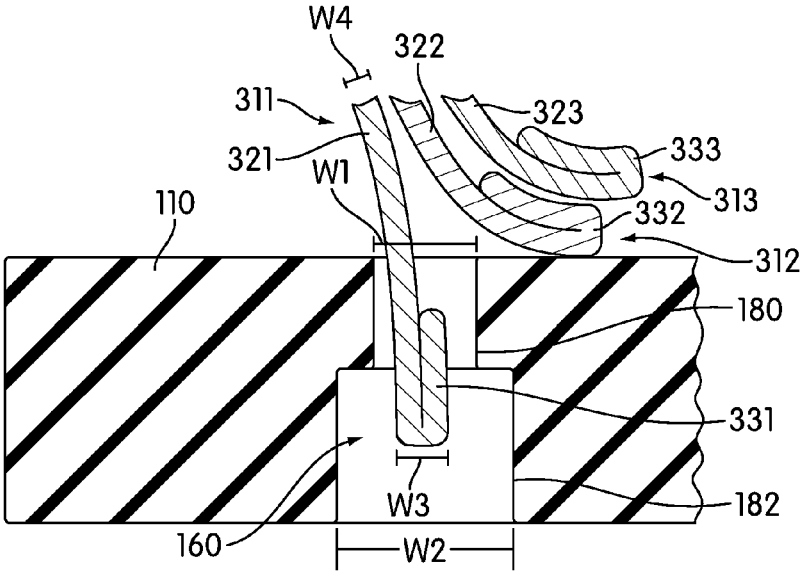
FIG. 7 is a cross sectional view of an embodiment of a strap being inserted through an aperture in a sole structure.

Initially, first separable portion 311 may be inserted into top portion 180 of first aperture 160, as seen in FIGS. 6 and 7. In this exemplary embodiment, width W3 of first widened portion 331 is substantially smaller than width W1 of top portion 180. This configuration allows first widened portion 331 to be easily inserted through top portion 180 of first aperture 160.

Figure 8:
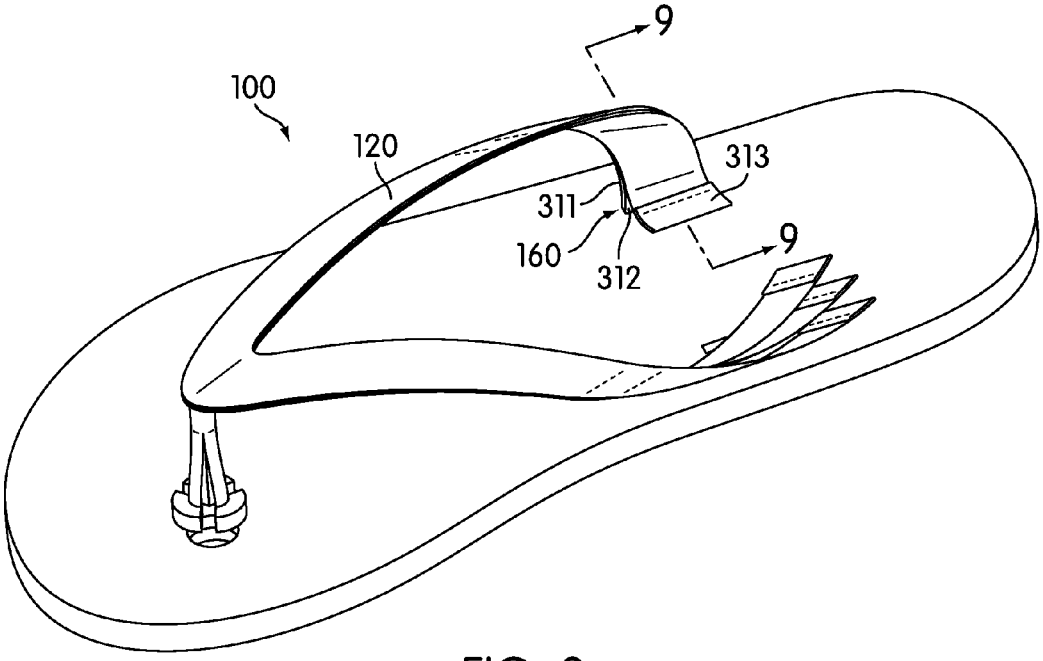
FIG. 8 is an isometric view of an embodiment of a strap being inserted through an aperture in a sole structure.
Figure 9:
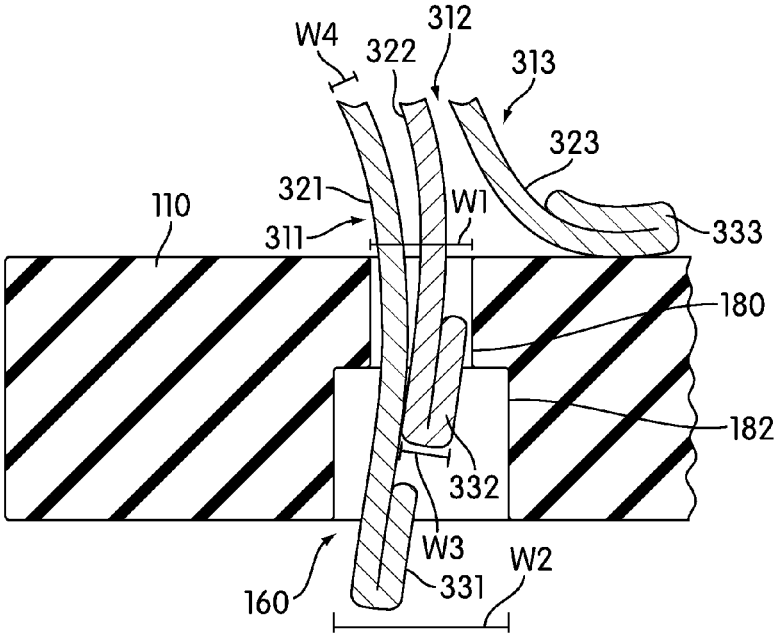
FIG. 9 is a cross sectional view of an embodiment of a strap being inserted through an aperture in a sole structure.

Next, after first separable portion 311 has been inserted through top portion 180 of first aperture 160, second separable portion 312 may be inserted into first aperture 160, as seen FIGS. 8 and 9. In this embodiment, top portion 180 of first aperture 160 is wide enough to receive second widened portion 332 of second separable portion 312 as well as first narrow portion 321 of first separable portion 311. In other words, width W1 of top portion 180 is large enough to accommodate the combined widths of first narrow portion 321 (with width W4) and second widened portion 332 (with width W3). In some cases, first separable portion 311 may be substantially lowered through first aperture 160 to provide clearance for second widened portion 332 to completely insert through top portion 180 of first aperture 160.

Figure 10:
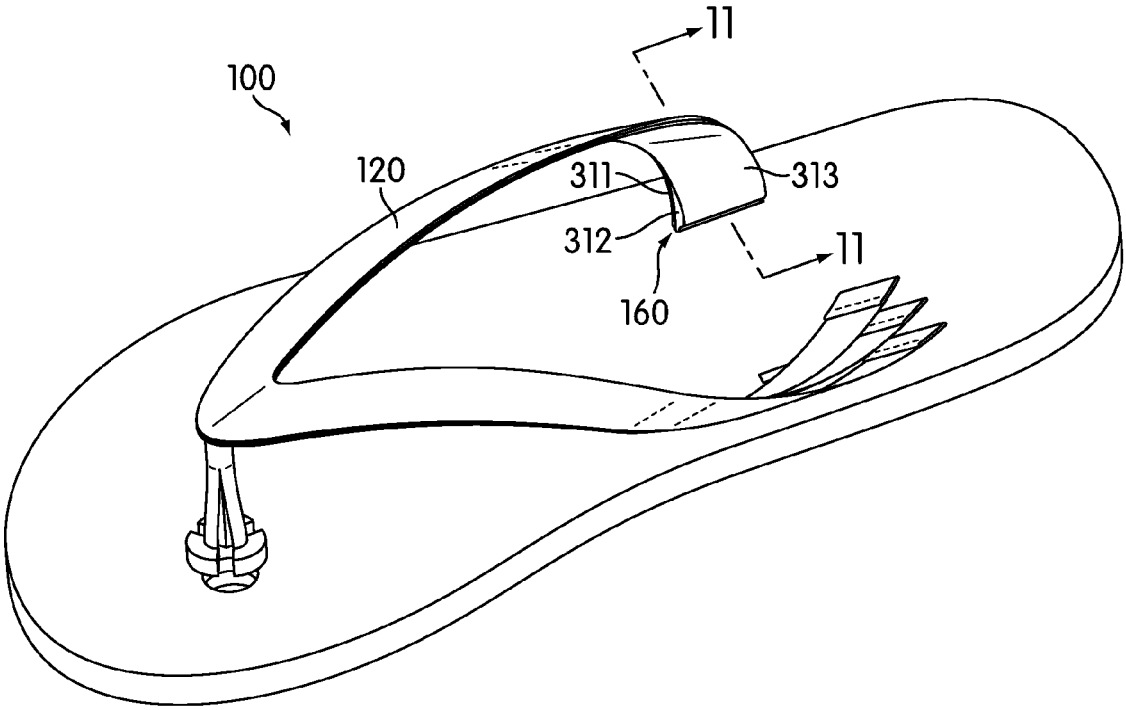
FIG. 10 is an isometric view of an embodiment of a strap being inserted through an aperture in a sole structure.
Figure 11:
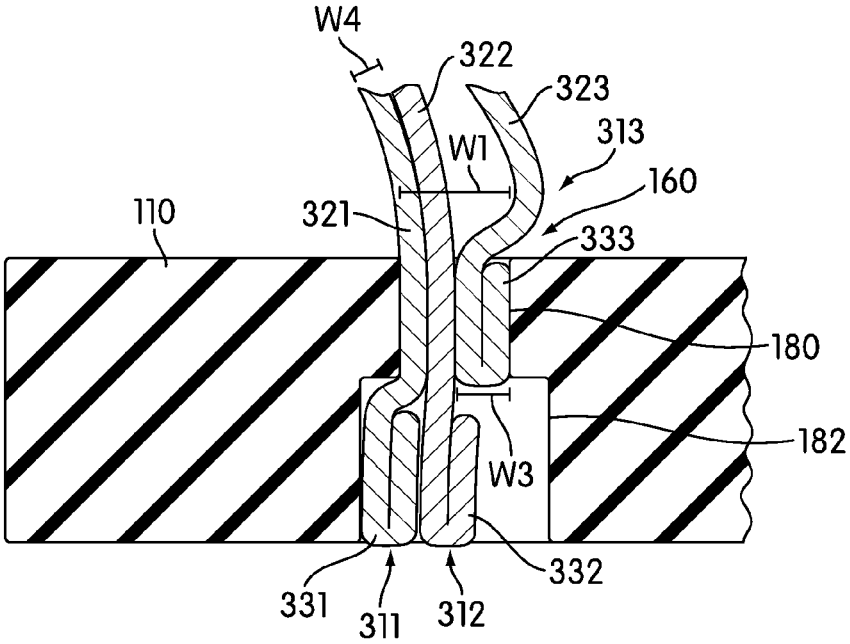
FIG. 11 is a cross sectional view of an embodiment of a strap being inserted through an aperture in a sole structure.

After second separable portion 312 has been fully inserted through top portion 180 of first aperture 160, third separable portion 313 may be inserted into first aperture 160, as seen in FIGS. 10 and 11. In this case, third widened portion 333 of third separable portion 313 may have a substantially similar width to first widened portion 331 and second widened portion 332. In this embodiment, top portion 180 of first aperture 160 is wide enough to receive third widened portion 333 as well as both first narrow portion 321 and second narrow portion 322.

Figure 12:
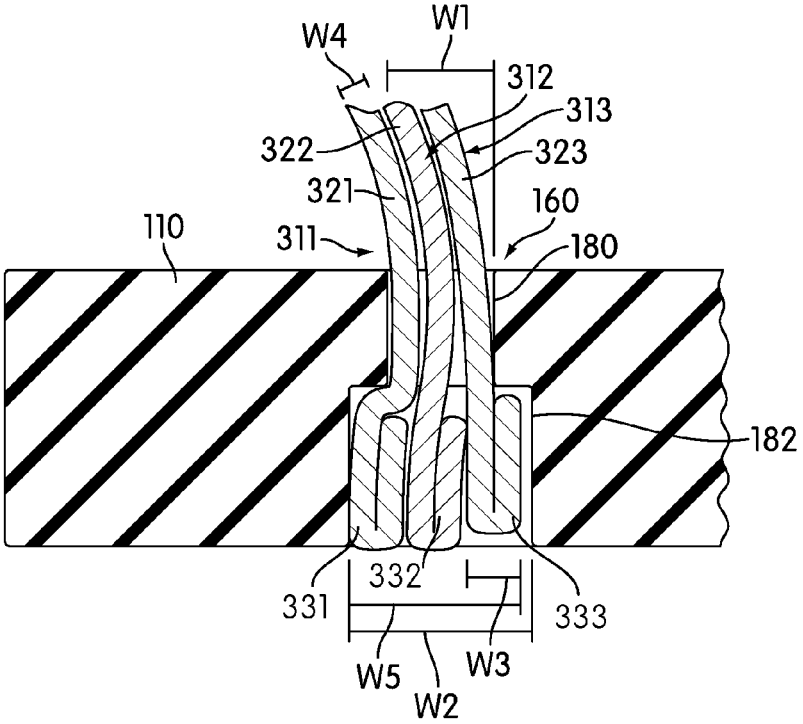
FIG. 12 is a cross sectional view of an embodiment of a strap fully inserted through an aperture in a sole structure.

Referring now to FIG. 12, first widened portion 331, second widened portion 332 and third widened portion 333 have all been fully inserted through top portion 180 of first aperture 160. At this point, first separable portion 311, second separable portion 312 and third separable portion 313 may be in a combined position within first aperture 160. In particular, in some cases, top portion 180 of first aperture 160 may prevent first separable portion 311, second separable portion 312 and third separable portion 313 from substantially separating.

As discussed above, lower portion 182 of first aperture 160 may be provided with width W2 that is large enough to accommodate first widened portion 331, second widened portion 332 and third widened portion 333 simultaneously. In addition, top portion 180 of first aperture 160 is wide enough to receive first narrow portion 321, second narrow portion 322 and third narrow portion 323 simultaneously. However, first widened portion 331, second widened portion 332 and third widened portion 333 have a combined width W5 that is substantially larger than width W1 of top portion 180. With this arrangement, first separable portion 311, second separable portion 312 and third separable portion 313 may not be pulled back through top portion 180 of first aperture 160.

Figure 13:
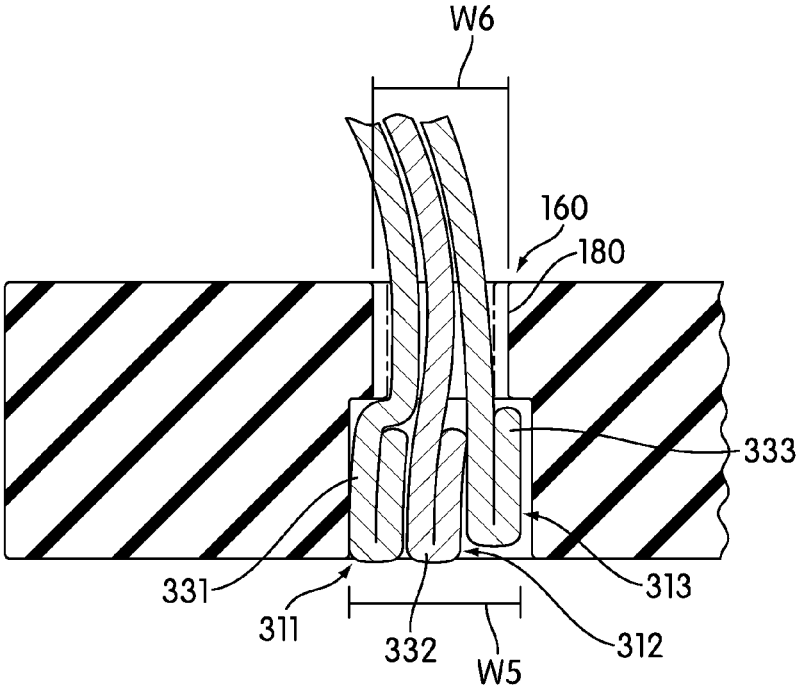
FIG. 13 is a cross sectional view of an embodiment of a strap fully inserted through an aperture in a sole structure.

In some cases, a sole structure could be made of a sufficiently elastic material that allows for some stretching of an aperture. Referring to FIG. 13, top portion 180 of first aperture 160 may have stretched width W6, which is the maximum possible width of top portion 180 under stretching forces. In an exemplary embodiment, first widened portion 331, second widened portion 332 and third widened portion 333 may have combined width W5 that is substantially larger than stretched width W6. In other words, first widened portion 331, second widened portion 332 and third widened portion 333 may not fit through top portion 180 of first aperture 160 even in a stretched condition. This arrangement helps to securely fasten first strap 120 to sole structure 110.

An article of footwear can include provisions for releasably securing a thong portion with separable portions to an aperture of a sole structure. In some embodiments, widened portions of the separable portions could be provided with cross-sectional areas that may fit into the aperture. In addition, the combined cross-sectional area of the widened portions in a combined position could be larger than the aperture cross-sectional area to prevent the separable portions from pulling out of the aperture.

FIGS. 14 through 19 illustrate embodiments of a method of fastening thong portion 200 with sole structure 110. Referring to FIGS. 14 through 19, thong portion 200 may be disposed in the separated position such that first separable portion 211, second separable portion 212 and third separable portion 213 are separated and may move substantially independently of one another.

For purposes of understanding the current embodiments, the term cross-sectional area is used. In conjunction with an aperture of a sole structure, the term cross-sectional area may refer to an area of the aperture that is substantially perpendicular to a vertical direction of the sole. In embodiments where an aperture has a substantially cylindrical shape, the cross-sectional area may be a circular cross section that is perpendicular to an axis of the hole. In other embodiments, however, the term cross-sectional area could refer to any area of an aperture oriented in any other direction. In conjunction with a separable portion, the term cross-sectional area may refer to an area of the separable portion that is substantially perpendicular to a longitudinal direction of the separable portion, which is a direction running along a length of the separable portion. In other embodiments, however, the term cross-sectional area may refer to any area of the separable portion that is oriented in any other direction.

In some embodiments, third aperture 164 may be associated with cross-sectional area A1. In particular, cross-sectional area A1 may characterize the cross-sectional size of top portion 190 of third aperture 164. In some cases, cross sectional area A1 may be an area that is substantially perpendicular to a vertical direction of sole structure 110. In addition, in some cases, first widened portion 231, second widened portion 232 and third widened portion 233 may be provided with substantially similar cross-sectional areas. In one embodiment, first widened portion 231, second widened portion 232 and third widened portion 233 may be provided with cross-sectional area A2. In other embodiments, however, first widened portion 231, second widened portion 232 and third widened portion 233 may be provided with substantially different cross-sectional areas. Additionally, in some embodiments, first narrow portion 221, second narrow portion 222 and third narrow portion 223 may be provided with cross-sectional area A3. Although the cross-sectional areas of first narrow portion 221, second narrow portion 222 and third narrow portion 223 are substantially similar in the current embodiment, in other embodiments, the cross-sectional areas of first narrow portion 221, second narrow portion 222 and third narrow portion 223 may be substantially different.

Figure 14:
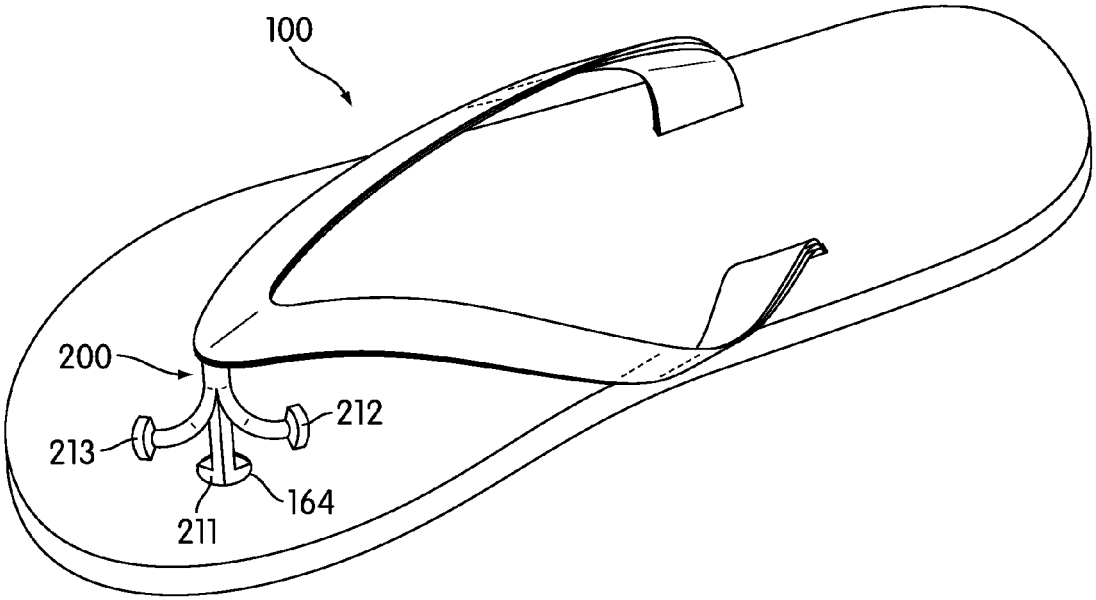
FIG. 14 is an isometric view of an embodiment of a thong portion being inserted through an aperture in a sole structure.
Figure 15:
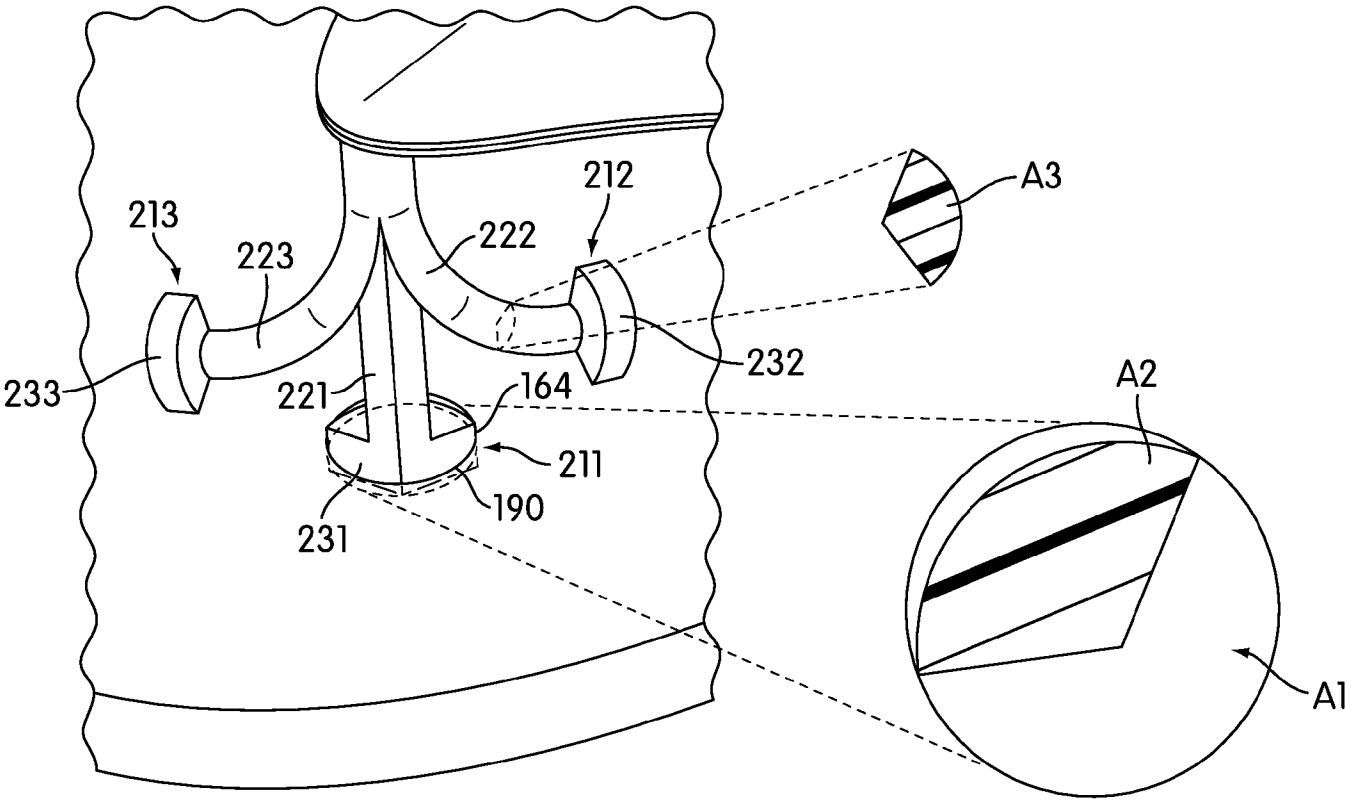
FIG. 15 is an enlarged isometric view of an embodiment of a thong portion being inserted through an aperture in a sole structure.

Initially, to secure thong portion 200 to sole structure 110, first separable portion 211 may be inserted into top portion 190 of third aperture 164, as seen in FIGS. 14 and 15. In this exemplary embodiment, cross-sectional area A2 of first widened portion 231 is substantially smaller than cross-sectional area A1 of top portion 190 third aperture 164. This configuration allows first widened portion 231 to be easily inserted through top portion 190 of third aperture 164.

Figure 16:
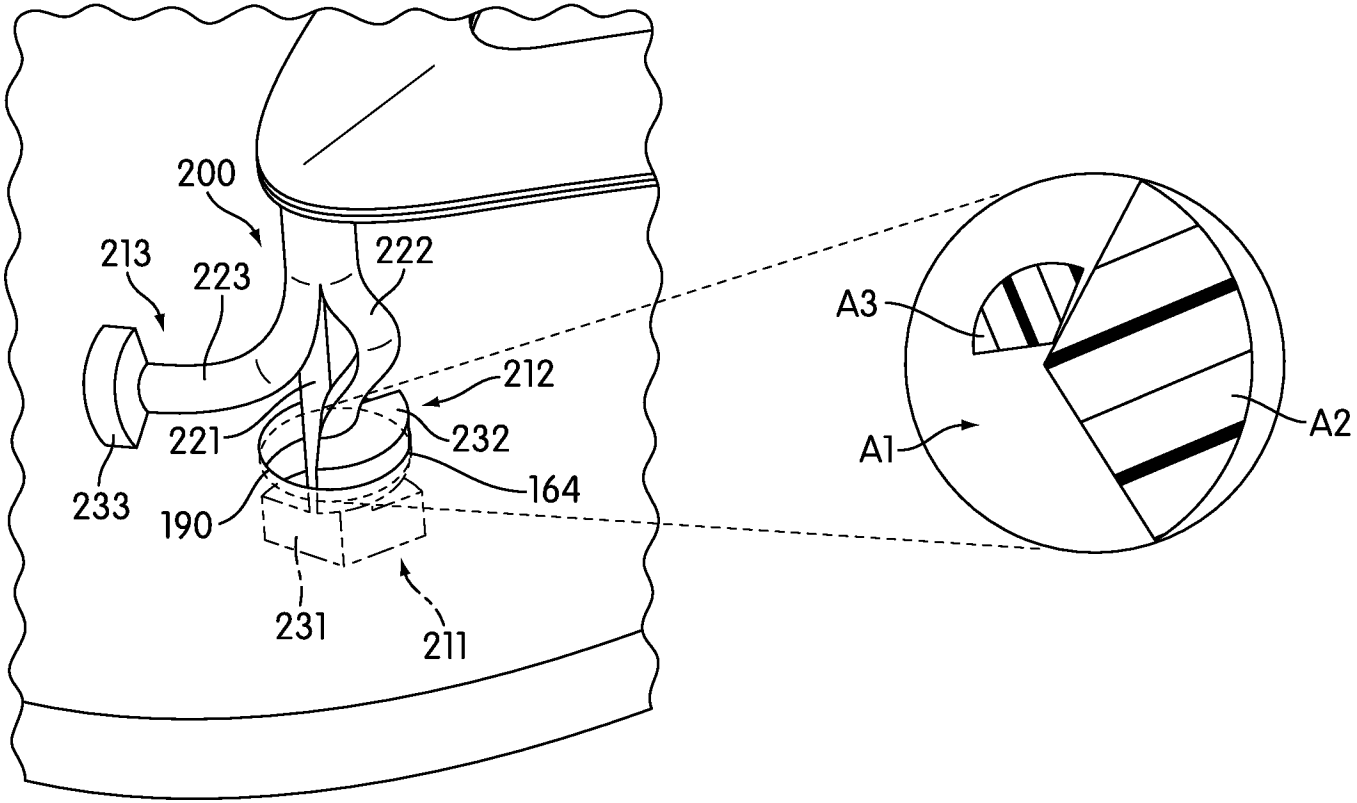
FIG. 16 is an enlarged isometric view of an embodiment of a thong portion being inserted through an aperture in a sole structure.

Next, after first separable portion 211 has been inserted through top portion 190 of third aperture 164, second separable portion 212 may be inserted into third aperture 164, as seen in FIG. 16. In this embodiment, top portion 190 of third aperture 164 is wide enough to receive second widened portion 232 of second separable portion 212 as well as first narrow portion 221 of first separable portion 211. In other words, cross-sectional area A1 of top portion 190 is large enough to accommodate the combined cross-sectional areas of first narrow portion 221 (with cross-sectional area A3) and second widened portion 232 (with cross-sectional area A2). In some cases, first separable portion 211 may be substantially lowered through third aperture 164 to provide clearance for second widened portion 232 to completely insert through top portion 190 of third aperture 164.

Figure 17:
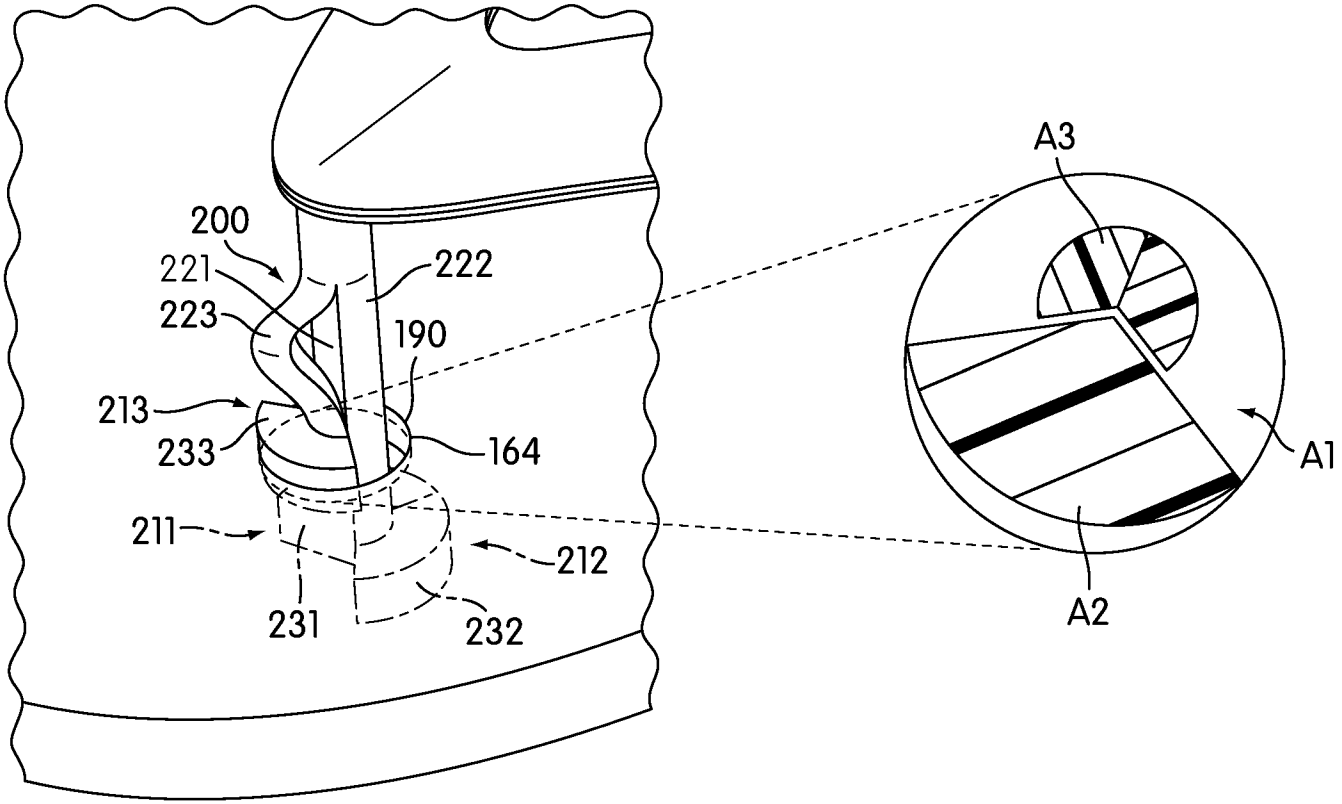
FIG. 17 is an enlarged isometric view of an embodiment of a thong portion being inserted through an aperture in a sole structure.

After second separable portion 212 has been fully inserted through top portion 190 of third aperture 164, third separable portion 213 may be inserted into third aperture 190, as seen in FIG. 17. In this case, third widened portion 233 of third separable portion 213 may have a substantially similar cross-sectional area to first widened portion 231 and second widened portion 232. In this embodiment, top portion 190 of third aperture 164 is large enough to receive third widened portion 233 as well as both first narrow portion 221 and second narrow portion 222.

Figure 18:
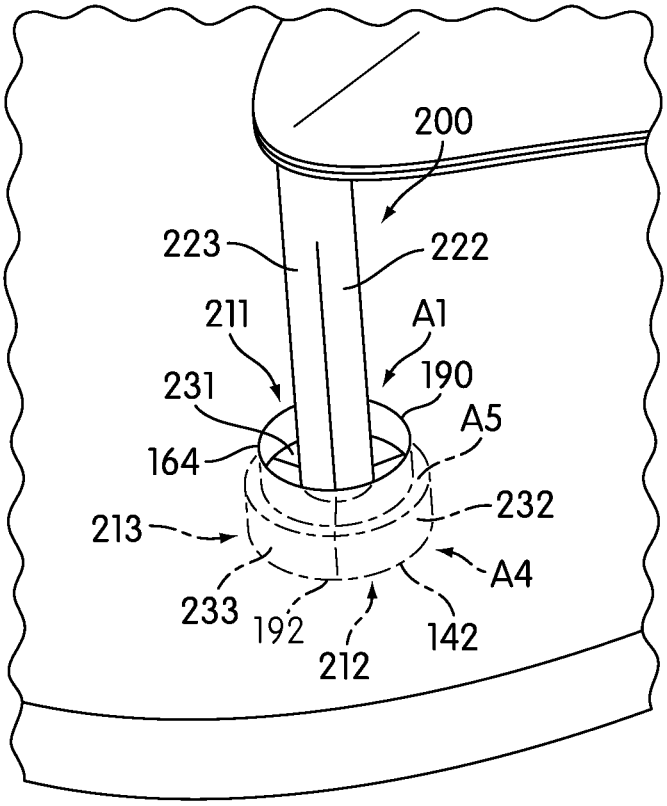
FIG. 18 is an isometric view of an embodiment of an article of footwear with a thong portion fully inserted into an aperture in a sole structure.

Referring now to FIG. 18, first widened portion 231, second widened portion 232 and third widened portion 233 have all been fully inserted through top portion 190 of third aperture 164. At this point, thong portion 200 may be in a combined position. In particular, top portion 190 of third aperture 164 may prevent first separable portion 211, second separable portion 212 and third separable portion 213 from substantially separating.

In some embodiments, lower portion 192 of third aperture 164 may be provided with cross-sectional area A4 that is large enough to accommodate first widened portion 231, second widened portion 232 and third widened portion 233 simultaneously. In addition, top portion 190 of third aperture 164 may be large enough to accommodate first narrow portion 221, second narrow portion 222 and third narrow portion 223 simultaneously. However, first widened portion 231, second widened portion 232 and third widened portion 233 have a combined cross-sectional area A5 that is substantially larger than cross-sectional area A1 of top portion 190. With this arrangement, first separable portion 211, second separable portion 212 and third separable portion 213 may not be pulled back through top portion 190 of third aperture 164.

Figure 19:
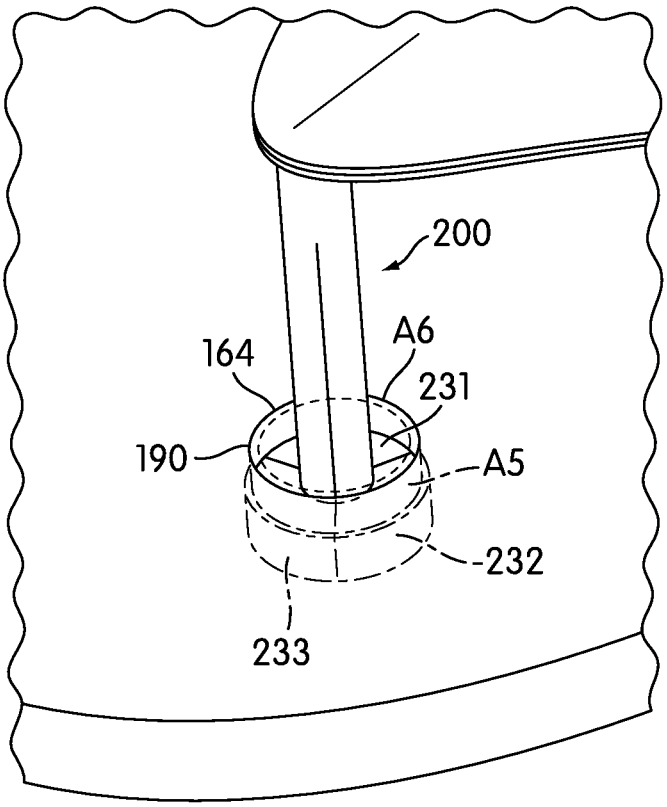
FIG. 19 is an isometric view of an embodiment of an article of footwear with a thong portion fully inserted into an aperture in a sole structure.

In some cases, a sole structure could be made of a sufficiently elastic material that allows for some stretching of an aperture. Referring to FIG. 19, top portion 190 of third aperture 164 may have stretched cross-sectional area A6, which is the maximum possible cross-sectional area of top portion 190 under stretching forces. In an exemplary embodiment, combined cross-sectional area A5 of first widened portion 231, second widened portion 232 and third widened portion 233 may be substantially larger than stretched cross-sectional area A6. In other words, first widened portion 231, second widened portion 232 and third widened portion 233 may not fit through top portion 190 of third aperture 164 even in a stretched condition. This arrangement helps to securely fasten thong portion 200 to sole structure 110.

Figure 20:
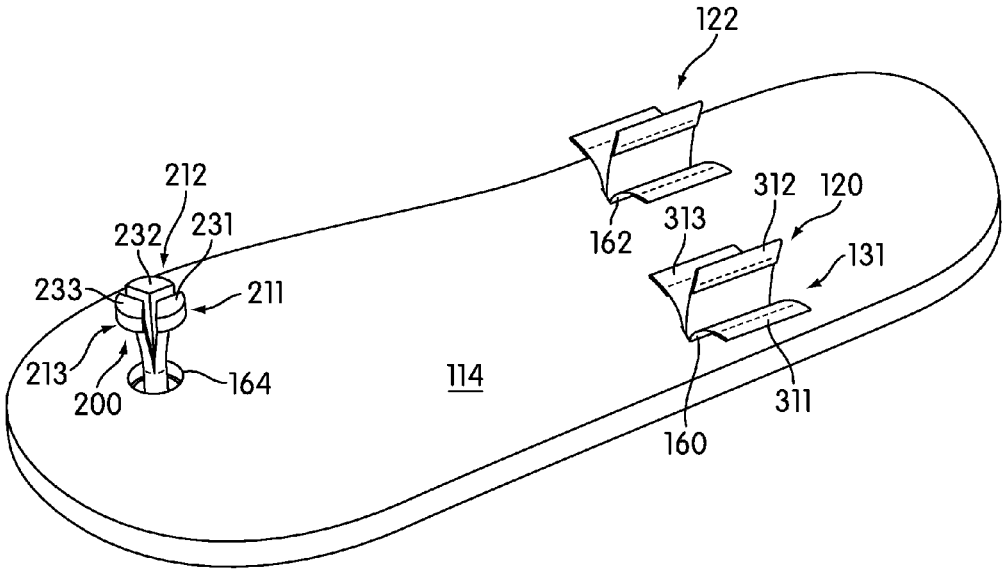
FIG. 20 is an isometric view of an embodiment of a lower portion of a sole structure.
Figure 21:
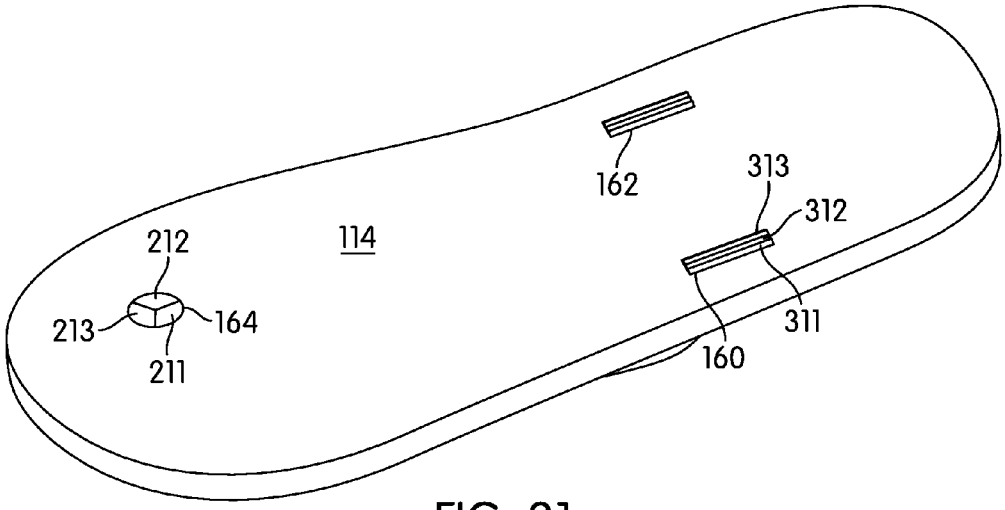
FIG. 21 is an isometric view of an embodiment of a lower portion of a sole structure.

FIGS. 20 and 21 illustrate embodiments of lower portion 114 of sole structure 110. Referring to FIG. 20, first end portion 131 of first strap 120 is inserted through first aperture 160. In this case, first separable portion 311, second separable portion 312 and third separable portion 313 are in a separated position. In a similar manner, second strap 122 includes separable portions in a separated position. In addition, thong portion 200 is disposed through third aperture 164. In this case, first separable portion 211, second separable portion 212 and third separable portion 213 are in a separated position. Referring to FIG. 20, as stresses are applied to first strap 120 and second strap 122, first end portion 131 of first strap 120 and first end portion 141 of second strap 122 are pulled flush with lower portion 114 of sole structure 110. In particular, first separable portion 311, second separable portion 312 and third separable portion 313 of first strap 120 and separable portions of second strap 122 are moved to a combined position and may be restrained within first aperture 160 and second aperture 162, respectively. In a similar manner, thong portion 200 may be pulled flush with lower portion 114. In particular, first separable portion 211, second separable portion 212 and third separable portion 213 are moved to a combined position and may be restrained within third aperture 164. With this arrangement, lower portion 114 may be provided with a substantially smooth outer surface that facilitates smooth ground engagement.

Figure 22:
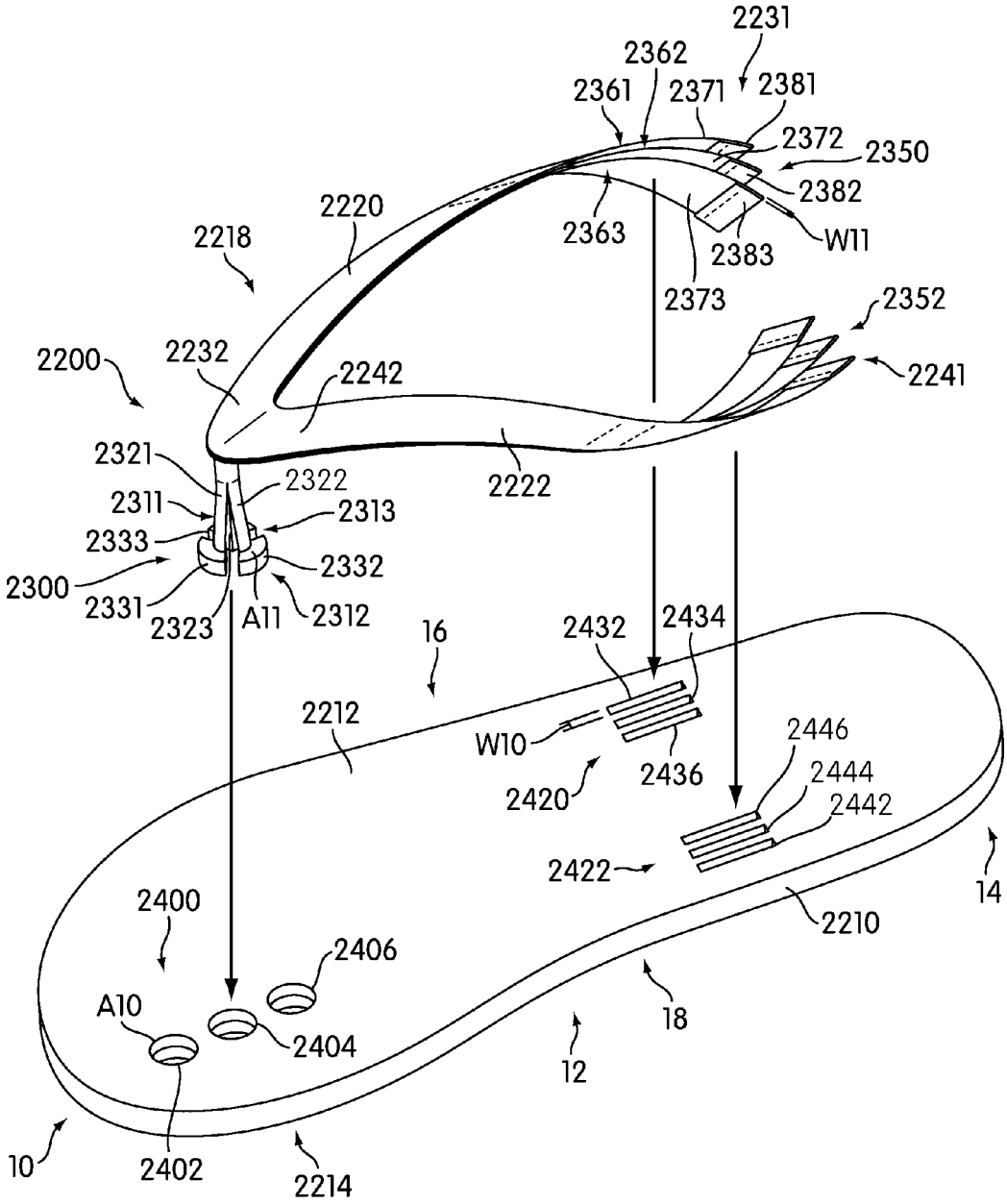
FIG. 22 is an isometric exploded view of an embodiment of an article of footwear.

FIGS. 22 through 25 illustrate another embodiment of an article of footwear 2200. Referring now to FIG. 22, article 2200 may be substantially similar to article 100 discussed in the previous embodiment. Article 2200 may be associated with forefoot portion 10, midfoot portion 12 and heel portion 14. Additionally, article 2200 may be associated with lateral side 16 and medial side 18. Furthermore, article 2200 may comprise sole structure 2210, including top portion 2212 and lower portion 2214.

In some embodiments, article 2200 can include provisions for securing a foot to sole structure 2210. In some cases, article 2200 can include one or more straps that may wrap around a portion of a foot. In one embodiment, article 2200 can include strap assembly 2218 that includes first strap 2220 and second strap 2222. First strap 2220 may include first end portion 2231 that is associated with lateral side 16 of sole structure 2210. Second strap 2222 may include first end portion 2241 that is associated with medial side 18 of sole structure 2210. In addition, first strap 2220 may include second end portion 2232 that is associated with forefoot portion 10 of article 2200. Likewise, second strap 2222 may include second end portion 2242 that is associated with forefoot portion 10 of article 2200.

First strap 2220 and second strap 2222 can be associated with one or more fastening portions that are configured to engage with sole structure 2210. In some cases, first strap 2220 and second strap 2222 can be associated with thong portion 2300. Thong portion 2300 is a fastening portion that may be used for securing strap assembly 2218 to sole structure 2210. In addition, first strap 2220 and second strap 2222 can be associated with first fastening portion 2350 and second fastening portion 2352 that are disposed at first end portion 2231 and second end portion 2241, respectively, of sole structure 2210.

Thong portion 2300 can comprise two or more separable portions. In some cases, thong portion 2300 may comprise first separable portion 2311, second separable portion 2312 and third separable portion 2313. Each of first separate portion 2311, second separable portion 2312 and third separable portion 2313 may further comprise first narrow portion 2321, second narrow portion 2322 and third narrow portion 2323, respectively. Similarly, first separable portion 2311, second separable portion 2312 and third separable portion 2313 may further comprise first widened portion 2331, second widened portion 2332 and third widened portion 2333, respectively. In particular, this arrangement may be substantially similar to the arrangement described for thong portion 2300 in the previous embodiment.

First fastening portion 2350 and second fastening portion 2352 can also be associated with two or more separable portions. In some embodiments, first fastening portion 2350 may comprise first separable portion 2361, second separable portion 2362 and third separable portion 2363. Each of first separable portion 2361, second separable portion 2362 and third separable portion 2363 may be associated with first narrow portion 2371, second narrow portion 2372 and third narrow portion 2373, respectively. Similarly, first separable portion 2361, second separable portion 2362 and third separable portion 2363 may comprise first widened portion 2381, second widened portion 2382 and third widened portion 2383, respectively. In particular, this arrangement may be substantially similar to the arrangement described for first strap 120 and second strap 122 in the previous embodiment. Likewise, second fastening portion 2352 may comprise three separable portions that are similar to the separable portions of first fastening portion 2350.

In some embodiments, sole structure 2210 can include provisions for varying the width and/or length of a strap assembly. In some cases, a sole structure can include a plurality of different apertures that allow a strap assembly to attach to the sole structure in various ways.

In one embodiment, sole structure 2210 can comprise first aperture set 2400. First aperture set 2400 may comprise two or more apertures that are configured to engage with thong portion 2300. In the current embodiment, first aperture set 2400 may include first aperture 2402, second aperture 2404 and third aperture 2406.

Generally, the cross sectional sizes of apertures within first aperture set 2400 can vary. In some cases, each aperture of first aperture set 2400 can have a substantially different cross sectional size. In other cases, each aperture of first aperture set 2400 can have a substantially similar cross sectional size. In an exemplary embodiment, each aperture of first aperture set 2400 may have a substantially similar cross sectional size. In this case, each aperture in first aperture set 2400 has cross sectional area A10. Moreover, cross sectional area A10 may be selected to be substantially larger than cross sectional area A11 of first widened portion 2331, second widened portion 2332 and third widened portion 2333 of thong portion 2300. Also, cross sectional area A10 may be selected to be substantially smaller than combined cross sectional area A12 (see FIG. 23) for first widened portion 2331, second widened portion 2332 and third widened portion 2333 of thong portion 2300. Still further, in some cases, the stretched cross sectional area of each aperture of first aperture set 2400 may be substantially smaller than combined cross sectional area A12. With this arrangement, thong portion 2300 can be inserted into any of the apertures of first aperture set 2400 by individually inserting first separable portion 2311, second separable portion 2312 and third separable portion 2313 through an aperture. This arrangement also prevents thong portion 2300 from being removed from an aperture as long as first separable portion 2311, second separable portion 2312 and third separable portion 2313 remain in the combined position.

Generally, apertures comprising first aperture set 2400 can be arranged in any manner. In some cases, apertures of first aperture set 2400 may be arranged in generally lateral configuration. In other cases, apertures of first aperture set 2400 can be arranged in a generally longitudinal configuration. In still other cases, apertures of first aperture set 2400 can be arranged in a generally diagonal configuration. In an exemplary embodiment, apertures of first aperture set 2400 can be arranged in an approximately longitudinal configuration. This arrangement can allow for a generally lengthwise adjustment of strap assembly 2218 in order to accommodate feet of varying lengths.

Although the current embodiment includes three apertures for engaging a thong portion, in other embodiment any other number of apertures could be used. In another embodiment, for example, only two apertures could be used. In still another embodiment, four or more apertures could be used. Furthermore, by varying the number of apertures, as well as the spacing between adjacent apertures, the degree to which the length of a strap can be adjusted can be fined tuned. In other words, by increasing the number of apertures, the number of different foot lengths that an article can achieve may be increased.

Sole structure 2210 can also comprise second aperture set 2420 and third aperture set 2422. Second aperture set 2420 may comprise two or more apertures that are configured to engage with first fastening portion 2350. In the current embodiment, second aperture set 2420 can include first aperture 2432, second aperture 2434 and third aperture 2436. In a similar manner, third aperture set 2422 may comprise two or more apertures that are configured to engage with second fastening portion 2352. In the exemplary embodiment, third aperture set 2422 comprise three apertures that are substantially similar to the apertures of second aperture set 2420. In particular, third aperture set 2422 includes first aperture 2442, second aperture 2444 and third aperture 2446.

Generally, the cross sectional sizes of apertures within second aperture set 2420 can vary. In some cases, each aperture of second aperture set 2420 can have a substantially different width. In other cases, each aperture of second aperture set 2420 can have a substantially similar width. In an exemplary embodiment, each aperture of second aperture set 2420 may have a substantially similar width. In this case, each aperture in second aperture set 2420 has width W10. Moreover, width W10 may be selected to be substantially larger than width W11 of first widened portion 2381, second widened portion 2382 and third widened portion 2383 of first fastening portion 2350. Also, width W10 may be selected to be substantially smaller than combined width W12 (see FIG. 23) for first widened portion 2381, second widened portion 2382 and third widened portion 2383 of first fastening portion 2350. With this arrangement, first fastening portion 2350 can be inserted into any of the apertures of second aperture set 2420 by individually inserting first separable portion 2361, second separable portion 2362 and third separable portion 2363 through an aperture. This arrangement also prevents first fastening portion 2350 from being removed from an aperture as long as first separable portion 2361, second separable portion 2362 and third separable portion 2363 remain in the combined position.

Generally, apertures comprising second aperture set 2420 can be arranged in any manner. In some cases, apertures of second aperture set 2420 may be arranged in generally lateral configuration. In other cases, apertures of second aperture set 2420 can be arranged in a generally longitudinal configuration. In still other cases, apertures of second aperture set 2420 can be arranged in a generally diagonal configuration. In an exemplary embodiment, apertures of second aperture set 2420 can be arranged in an approximately lateral configuration. This arrangement can allow for a generally widthwise adjustment of strap assembly 2218 in order to accommodate feet of varying widths.

Although the current embodiment includes three apertures for engaging a fastening portion of a strap, in other embodiments any other number of apertures could be used. In another embodiment, for example, only two apertures could be used. In still another embodiment, four or more apertures could be used. Furthermore, by varying the number of apertures, as well as the spacing between adjacent apertures, the degree to which the width of a strap can be adjusted can be fined tuned. In other words, by increasing the number of apertures, the number of different foot widths that an article can achieve may be increased.

Figure 23:
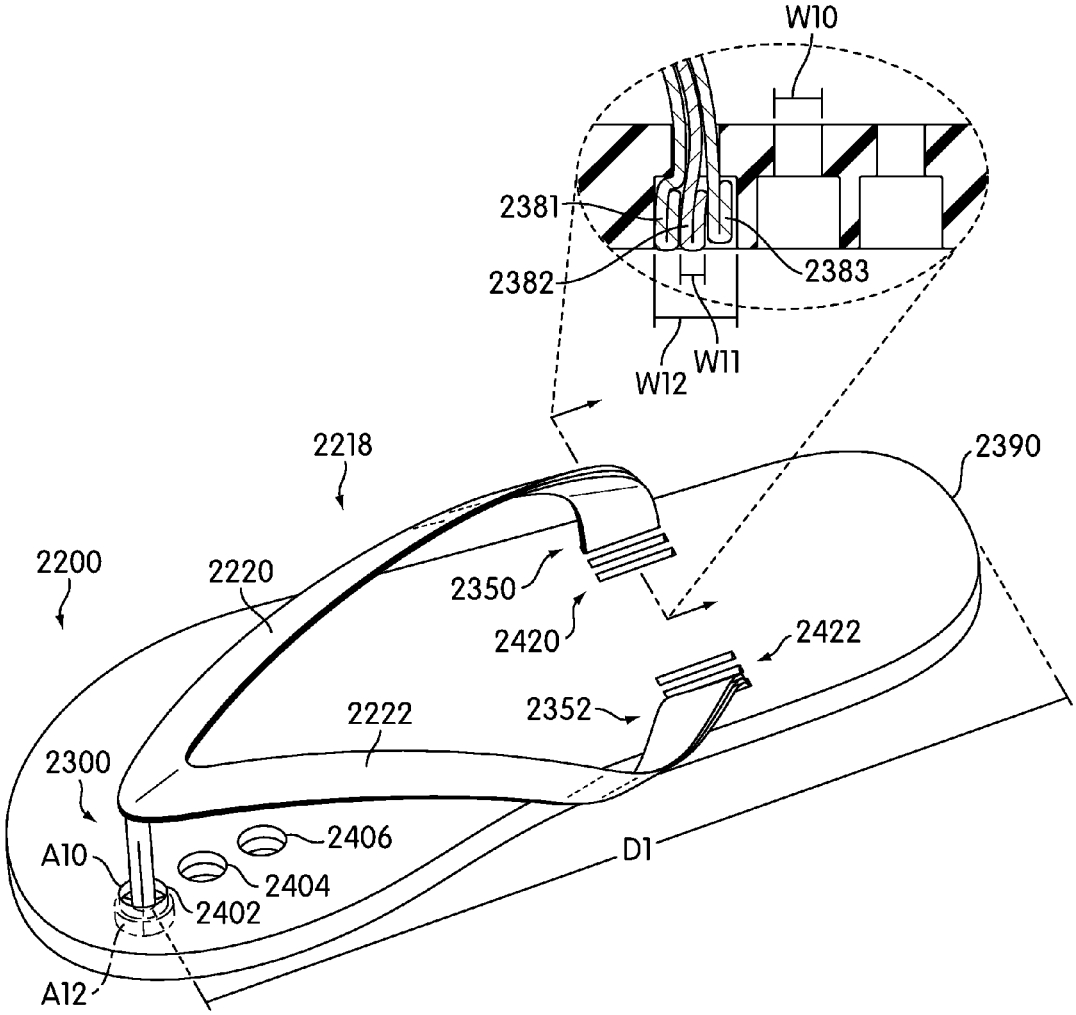
FIG. 23 is an isometric view of an embodiment of an article of footwear.
Figure 24:
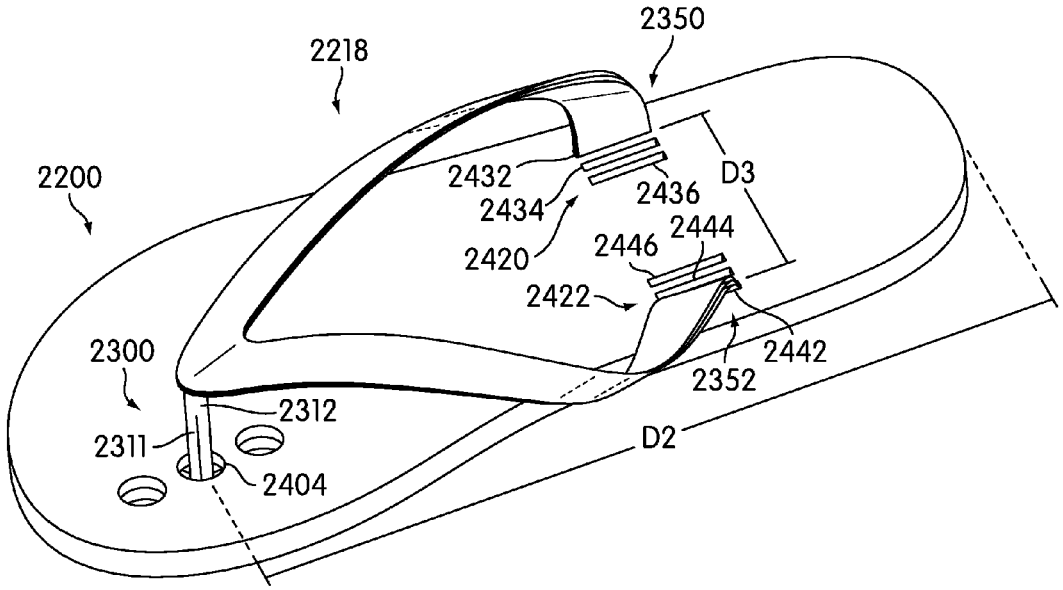
FIG. 24 is an isometric view of an embodiment of an article of footwear.

Using the arrangement discussed here, the length and/or width of a strap assembly could be varied by inserting various fastening portions of the strap assembly into different apertures on sole structure 2210. For example, the configuration illustrated in FIG. 23 shows thong portion 2300 engaged with first aperture 2402. In this position, thong portion 2300 is disposed distance D1 from rearward edge 2390. In this case, strap assembly 2218 is configured to engage a foot of a first predetermined length. In order to configure article 2200 for a foot of a substantially shorter length, thong portion 2300 may be removed from first aperture 2402 and inserted into second aperture 2404, as illustrated in FIG. 24. It will be understood that thong portion 2300 can be removed from first aperture 2402 by individually removing each of first separable portion 2311, second separable portion 2312 and third separable portion 2313 (see FIG. 22) from first aperture 2402. In other words, each separable portion may be inserted through first aperture 2402 in a separated position. This may be accomplished by reversing the process of inserting separable portions of a thong portion through an aperture, which is illustrated in FIGS. 14 through 19.

As illustrated in FIG. 24, thong portion 2300 is inserted through second aperture 2404. In this position, thong portion 2300 is disposed distance D2 from rearward edge 2390. In this case, strap assembly 2218 is configured to engage a foot of a second predetermined length that is substantially less than the first predetermined length.

In a similar manner, the fastening portions of strap assembly 2218 can be adjusted to accommodate feet of varying widths. For example, the configuration illustrated in FIG. 24 shows first fastening portion 2350 engaged in first aperture 2432 of second aperture set 2420. Likewise, second fastening portion 2352 is engaged in first aperture 2442 of third aperture set 2422. With first fastening portion 2350 and second fastening portion 2352 in these positions, first fastening portion 2350 and second fastening portion 2352 are separated by approximately distance D3. In this case, strap assembly 2218 is configured to engage a foot of a first predetermined width. In order to configure article 2200 for a foot with a smaller width, the positions of first fastening portion 2350 and/or second fastening portion 2352 may be adjusted. In the exemplary embodiment, for example, first fastening portion 2350 may be moved to third aperture 2436 of second aperture set 2420, as illustrated in FIG. 24. Likewise, second fastening portion 2352 may be moved to third aperture 2446 of third aperture set 2422. It will be understood that first fastening portion 2350 can be removed from first aperture 2432 by individually removing each of first separable portion 2361, second separable portion 2362 and third separable portion 2263 (see FIG. 22) from first aperture 2432. In other words, each separable portion may be inserted through first aperture 2432 in a separated position. This may be accomplished by reversing the process of inserting separable portions of a strap through an aperture, which is illustrated in FIGS. 6 through 13. Second fastening portion 2352 can also be removed from first aperture 2442 in a similar manner.

Figure 25:
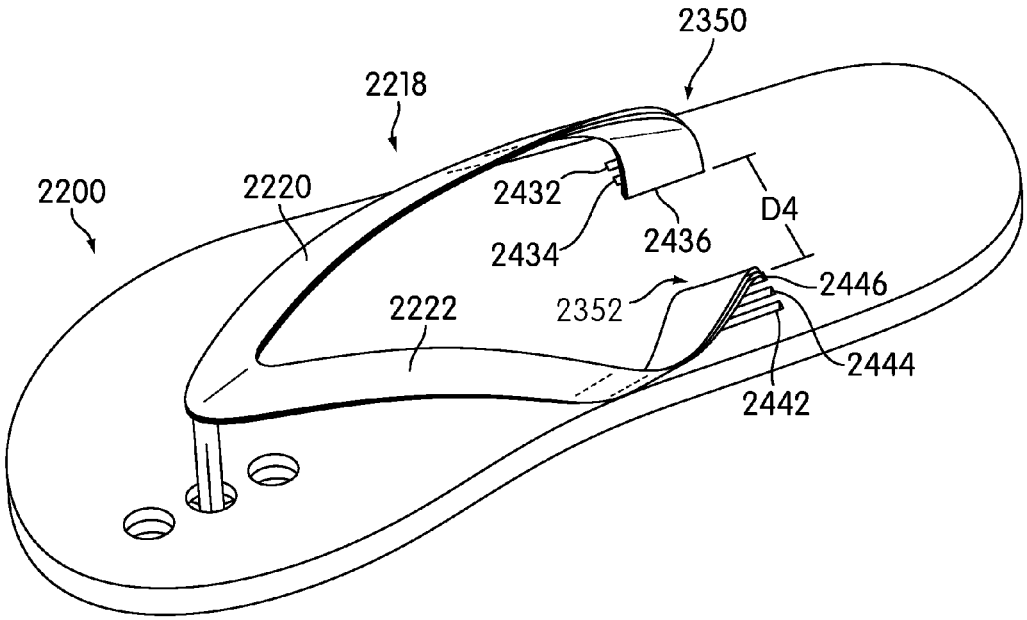
FIG. 25 is an isometric view of an embodiment of an article of footwear.

As illustrated in FIG. 25, first fastening portion 2350 and second fastening portion 2352 are disposed in third aperture 2436 of second aperture set 2420 and third aperture 2446 of third aperture set 2422, respectively. In this position, first fastening portion 2350 and second fastening portion 2352 are spaced apart by distance D4. In this configuration, strap assembly 2218 is configured to engage a foot with a second predetermined width that is substantially less than the first predetermined width.

Although the current embodiment illustrates multiple apertures associated with thong portion 2300 as well as first fastening portion 2350 and second fastening portion 2350 of strap assembly 2218, it will be understood that in other embodiments some apertures may be optional. For example, in some cases, only a single aperture may be provided for engaging thong portion 2300. Likewise, in other cases, only a single aperture may be provided for engaging first fastening portion 2350 and/or second fastening portion 2352.

Articles of the embodiments discussed above may be made from materials known in the art for making articles of footwear. For example, a sole structure may be made from any suitable material, including, but not limited to: elastomers, siloxanes, natural rubber, other synthetic rubbers, aluminum, steel, natural leather, synthetic leather, foams or plastics. In addition, a thong portion used with an article of footwear can be may from any suitable material, including, but not limited to: elastomers, siloxanes, natural rubber, other synthetic rubbers, leathers, foams or plastics. In one embodiment, a thong portion may be made from an elastomer material. Straps used with an article of footwear can be made from any suitable material including woven materials, fabrics, leathers, rubbers, elastomers as well as any other materials.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear, comprising:

a sole structure including a first aperture and a second aperture, wherein each of the first aperture and the second aperture extends from a top portion to a lower portion of the sole structure; and a thong portion disposed at one end of a strap, the thong portion including a fastening portion comprising a first separable portion, a second separable portion and a third separable portion;

the first separable portion having a first widened portion, the second separable portion having a second widened portion and the third separable portion having a third widened portion;

a top portion of the first aperture having a stretched cross-sectional area corresponding to the cross-sectional area of the first aperture in a fully stretched position and a normal cross-sectional area corresponding to the cross-sectional area of the first aperture in a non-stretched position;

the first widened portion having a cross-sectional area that is less than the normal cross-sectional area, the second widened portion having a cross-sectional area that is less than the normal cross-sectional area and the third widened portion having a cross-sectional area that is less than the normal cross-sectional area;

wherein a combined cross-sectional area of the first widened portion, the second widened portion and the third widened portion is greater than the stretched cross-sectional area of the first aperture;

wherein the fastening portion, which includes the plurality of separable portions, is removably inserted into the first aperture or the second aperture to attach the thong portion to the sole structure; and wherein the fastening portion of the thong portion is removably and selectively insertable into the first aperture and the second aperture to adjust the strap around a foot.

2. The article of footwear according to claim 1, wherein the first aperture has a generally rounded cross-sectional area.

3. The article of footwear according to claim 2, wherein the first widened portion, the second widened portion and the third widened portion each have a substantially wedge-like cross-sectional area.

4. The article of footwear according to claim 1, wherein the first separable portion, the second separable portion and the third separable portion are associated with a combined position and a separated position of the thong portion and wherein the first widened portion, the second widened portion and the third widened portion comprise a disc-like shape in the combined position.

5. The article of footwear according to claim 1, wherein a lower portion of the first aperture has a cross sectional area that is larger than the combined cross sectional area of the first widened portion, the second widened portion, and the third widened portion.

6. The article of footwear according to claim 5, wherein the first widened portion, the second widened portion and the third widened portion are substantially flush with the lower portion of the sole structure.

7. An article of footwear, comprising:

a sole structure including a first aperture and a second aperture disposed adjacent to the first aperture; and a thong portion disposed at one end of a strap, the thong portion including a fastening portion comprising a plurality of separable portions;

the fastening portion having a combined position and a separated position;

each separable portion of the plurality of separable portions having an end having a widened portion, each widened portion having a separated size in the separated position that is less than a size of the first aperture and less than a size of the second aperture;

the widened portions of the separable portions having a combined size in the combined position that is greater than the size of the first aperture and greater than the size of the second aperture;

wherein the fastening portion, which includes the plurality of separable portions, is removably inserted into the first aperture or the second aperture to attach the thong portion to the sole structure; and wherein the fastening portion is removably and selectively insertable into the first aperture and the second aperture to adjust the strap around a foot.

8. The article of footwear according to claim 7, further including a third aperture disposed adjacent to the first aperture or the second aperture;

wherein the fastening portion of the thong portion is removably and selectively insertable into the first aperture, the second aperture, and the third aperture to adjust the strap around a foot.

9. The article of footwear according to claim 7, wherein the first aperture and the second aperture each have a generally rounded cross-sectional area.

10. The article of footwear according to claim 7, wherein the first aperture is disposed adjacent to the second aperture in an approximately longitudinal direction.

11. The article of footwear according to claim 7, wherein the first aperture and the second aperture can be used to adjust the length of the strap.

12. The article of footwear according to claim 7, wherein the thong portion includes a first separable portion, a second separable portion and a third separable portion;

the first separable portion having a first widened portion, the second separable portion having a second widened portion and the third separable portion having a third widened portion;

a top portion of the first aperture having a stretched cross-sectional area in a fully stretched position and a normal cross-sectional area in a non-stretched position; and the first widened portion having a cross-sectional area that is less than the normal cross-sectional area, the second widened portion having a cross-sectional area that is less than the normal cross-sectional area and the third widened portion having a cross-sectional area that is less than the normal cross-sectional area;

wherein a combined cross-sectional area of the first widened portion, the second widened portion, and the third widened portion is greater than the stretched cross-sectional area of the first aperture.

13. The article of footwear according to claim 12, wherein a lower portion of the first aperture has a cross sectional area that is larger than the combined cross sectional area of the first widened portion, the second widened portion, and the third widened portion.

14. The article of footwear according to claim 13, wherein the first widened portion, the second widened portion, and the third widened portion are substantially flush with a lower portion of the sole structure.

15. The article of footwear according to claim 7, wherein the thong portion includes a first separable portion, a second separable portion and a third separable portion;

the first separable portion having a first widened portion, the second separable portion having a second widened portion, and the third separable portion having a third widened portion;

wherein the first widened portion, the second widened portion, and the third widened portion each have a substantially wedge-like cross-sectional area.

16. The article of footwear according to claim 15, wherein, when the fastening portion of the thong portion is in the combined position, the first widened portion, the second widened portion, and the third widened portion form a disc-like shape.

17. A method of assembling an article of footwear, comprising the steps of:

separating a first separable portion, a second separable portion, and a third separable portion of a fastening portion of a thong portion disposed at an end of a strap;

inserting a first widened portion of the first separable portion into a first aperture in the sole structure of the article of footwear, the sole structure further including a second aperture adjacent the first aperture, wherein the first aperture includes an upper portion that is substantially wider than the first widened portion;

inserting a second widened portion of the second separable portion into the first aperture, the first aperture being substantially wider than the second widened portion;

inserting a third widened portion of the third separable portion into the first aperture, the first aperture being substantially wider than the third widened portion;

wherein a combined width of the first widened portion, the second widened portion, and the third widened portion of the thong portion is substantially larger than a width of the first aperture such that the combined width of the first widened portion, the second widened portion, and the third widened portion attaches the thong portion to the sole structure of the article of footwear when the first widened portion, the second widened portion, and the third widened portion are all inserted into the first aperture; and wherein the fastening portion is removably and selectively insertable into the first aperture and the second aperture to attach the thong portion to the sole structure and adjust the strap around a foot.

18. The method of claim 17, wherein the first aperture is disposed adjacent to the second aperture in an approximately longitudinal direction.

19. The method of claim 18, wherein selectively inserting the fastening portion of the thong portion into the first aperture and the second aperture adjusts the length of the strap.

20. The method of claim 17, wherein the first widened portion, the second widened portion, and the third widened portion each have a substantially wedge-like cross-sectional area; and wherein, when the fastening portion of the thong portion is in a combined position, the first widened portion, the second widened portion, and the third widened portion form a disc-like shape.

* * * * *